US007481266B2

(12) United States Patent
Demuth et al.

(10) Patent No.: US 7,481,266 B2
(45) Date of Patent: Jan. 27, 2009

(54) HEAT EXCHANGER FOR A MOTOR VEHICLE

(75) Inventors: Walter Demuth, Gerlingen (DE); Martin Kotsch, Ludwigsburg (DE); Michael Kranich, Besigheim (DE); Hans Joachim Krauss, Stuttgart (DE); Hagen Mittelstrass, Bondorf (DE); Karl-Heinz Staffa, Stuttgart (DE); Christoph Walter, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 350 days.

(21) Appl. No.: 10/499,440

(22) PCT Filed: Dec. 19, 2002

(86) PCT No.: PCT/EP02/14581

§ 371 (c)(1),
(2), (4) Date: Jun. 21, 2004

(87) PCT Pub. No.: WO03/544466

PCT Pub. Date: Jul. 3, 2003

(65) Prior Publication Data

US 2005/0039901 A1 Feb. 24, 2005

(30) Foreign Application Priority Data

| | | |
|---|---|---|
| Dec. 21, 2001 | (DE) | 101 63 202 |
| Jul. 26, 2002 | (DE) | 102 34 118 |
| Aug. 29, 2002 | (DE) | 102 40 556 |

(51) Int. Cl.
*F28D 7/06* (2006.01)

(52) U.S. Cl. ..... 165/176; 165/172; 165/175

(58) Field of Classification Search ..... 165/147, 165/164, 165, 166, 167, 172, 175, 176, 173, 165/174

See application file for complete search history.

(56) References Cited

U.S. PATENT DOCUMENTS

| | | | | |
|---|---|---|---|---|
| 2,332,336 | A * | 10/1943 | Norris | 165/147 |
| 5,172,761 | A * | 12/1992 | Lyon | 165/173 |
| 5,242,016 | A | 9/1993 | Voss et al. | |
| 5,295,532 | A * | 3/1994 | Hughes | 165/173 |
| 5,605,191 | A * | 2/1997 | Eto et al. | 165/176 |
| 6,272,881 | B1 * | 8/2001 | Kuroyanagi et al. | 165/174 |
| 6,302,196 | B1 * | 10/2001 | Haussmann | 165/175 |
| 6,749,015 | B2 | 6/2004 | Moreau | |
| 2005/0103486 | A1 | 5/2005 | Demuth et al. | |

FOREIGN PATENT DOCUMENTS

| | | | |
|---|---|---|---|
| DE | 94 00 687 | U1 | 5/1995 |
| DE | 100 20 763 | A1 | 11/2000 |
| EP | 0 563 471 | A1 | 10/1993 |
| EP | 0 634 615 | A1 | 1/1995 |
| EP | 0 849 557 | A1 | 6/1998 |
| EP | 1 065 453 | A2 | 1/2001 |
| EP | 1 221 580 | A2 | 7/2002 |
| FR | 2 803 378 | A1 | 7/2001 |
| JP | 62-153685 | A | 7/1987 |

(Continued)

*Primary Examiner*—Ljiljana (Lil) V Ciric
(74) *Attorney, Agent, or Firm*—Foley & Lardner LLP

(57) ABSTRACT

Disclosed herein is a heat exchanger with tubes (1) and at least one end piece, which has a tube bottom that, in turn, has a bottom plate (8), a baffle plate (12) and a covering plate (16).

55 Claims, 14 Drawing Sheets

FOREIGN PATENT DOCUMENTS

| | | | |
|---|---|---|---|
| JP | 4-80593 | A | 3/1992 |
| JP | 5-26592 | A | 2/1993 |
| JP | 5-346297 | A | 12/1993 |
| JP | 2001-194087 | A | 7/2001 |
| JP | 2001-248995 | A | 9/2001 |
| WO | WO 99/23432 | A1 | 5/1999 |
| WO | WO 03/054465 | A1 | 7/2003 |
| WO | WO 03/054467 | A1 | 7/2003 |

* cited by examiner

HEAT EXCHANGER FOR A MOTOR VEHICLE

BACKGROUND OF THE INVENTION

The invention relates to a heat exchanger with tubes and with an end piece which has a tube plate comprising a plurality of individual plates.

A heat exchanger of this type is described, for example, in EP 0 563 471 A1. The heat exchanger disclosed by that document is designed as a two-row flat-tube evaporator which has two flows of medium passing through it. Corrugated fins which have ambient air flowing over them are located between the flat tubes. The refrigerant first of all flows through the rear row of flat tubes, as seen in the main direction of flow of the air, from the top downward and is then collected and diverted, by means of a diverter device, in the opposite direction to the direction of flow of the air, entering the first, i.e. front row of flat tubes, through which it flows from the bottom upward. With this design, therefore, the refrigerant is diverted over the depth, i.e. counter to the direction of flow of the air. As a result, the flow paths for the refrigerant in each case comprise two sections, with each section corresponding to a tube length. The refrigerant is distributed and collected by a collection and distribution device, which is formed by a multiplicity of plates which are layered on top of one another and are soldered together. These plates substantially comprise a base plate, a distributor plate above it, with a partition running in the longitudinal direction, and a cover plate with feed and discharge openings for the refrigerant. In a similar way, the diverter device arranged on the opposite side is composed of individual plates. This results in a low overall height of this evaporator. In addition, there is optionally what is known as a stop plate, which is in each case laid onto the base plate and forms a stop for the tube ends. One drawback of this type of evaporator is that the refrigerant, on account of the distribution or collection chamber extending over the entire width of the evaporator, is distributed unevenly to the individual tubes. Furthermore, the two-row design requires increased assembly outlay.

What is known as a divider plate with individual openings for distributing the refrigerant between the individual tubes has been proposed for a similar evaporator in EP 0 634 615 A1. This results in more uniform distribution of the refrigerant to the tubes, but this is at the expense of an increased number of plates and therefore higher outlay on materials and assembly.

U.S. Pat. No. 5,242,016 describes an evaporator with refrigerant distribution through passages in a large number of plates, which likewise contribute to a more uniform distribution of the refrigerant between heat-exchanger tubes. However, this requires a very large number of plates and high manufacturing costs.

DE 100 20 763 A1 has disclosed a further design of evaporator, which is intended for operation with $CO_2$ as refrigerant and in which a pressure-resistant collector housing is to be achieved by virtue of the fact that a multiplicity of plates provided with apertures are stacked on top of one another and soldered together. This evaporator is of one-row design, specifically with multi-chamber flat tubes through which medium flows both upward and downward, which is made possible by a diverter device located at the lower end of the tubes. One drawback of this design of evaporator is the large number of plates with relatively narrow passages, which firstly entails additional weight and secondly involves the risk of the passages in the collector housing being closed up during soldering, i.e. becoming blocked by solder.

EP 1 221 580 A2 has described an evaporator for a fuel cell system, which comprises a header piece which includes a base plate and a cover plate secured to it. Fuel passes via a connection part into a fuel distributor chamber, and from there into guide passages and via apertures in the base plate into heat-uptake passages of the evaporator. In this fuel evaporator, there is a small number of plates in the header piece, but these plates are highly complex to manufacture. Moreover, supply of fuel to the heat-uptake passages is very uneven depending on the pressure distribution in the fuel distributor chamber and in the guide passages.

SUMMARY OF PREFERRED EMBODIMENTS

The object of the invention is to provide a heat exchanger in which it is possible to realize a simple and/or lightweight design and if appropriate simultaneously a uniform distribution of a medium to a plurality of flow paths and/or a pressure-stable construction of the heat exchanger.

This object is achieved by a heat exchanger having the features of one of the independent claims 1, 14, 26, 29, 31, 33 or 36.

According to these claims, a heat exchanger according to the invention includes tubes through which a first medium can flow and around which a second medium can flow, so that heat can be transferred from the first medium to the second or vice versa through walls of the tubes. For this purpose, heat-exchange passages, through which the first medium can be passed, are located in the tubes, with an individual tube having either one heat-exchange passage or, as what is known as a multi-chamber tube, having a plurality of heat-exchange passages located next to one another. The tubes may in this case have a circular, oval, substantially rectangular or any other desired cross section. By way of example, the tubes are designed as flat tubes. To increase the heat transfer, it is if appropriate possible to arrange fins, in particular corrugated fins, between the tubes, in which case the tubes and the fins can in particular be soldered to one another. There are various conceivable uses for the heat exchanger, for example as an evaporator of a refrigerant circuit, in particular of a motor vehicle air-conditioning system. In this case, the first medium is a refrigerant, for example R134*a* or R744, and the second medium is air, with heat being transferred from the air to the refrigerant. However, the heat exchanger is also suitable for other media, in which case the heat can if appropriate also be transferred from the first medium to the second.

If appropriate, there are at least two collection chambers, it being possible for the first medium to be passed from a first collection chamber to a second collection chamber. The first medium can be passed along one or more flow paths which optionally comprise several sections. In the context of the invention, the term flow-path section is to be understood as meaning one or more heat-exchange passages which run from one side of the heat exchanger to an opposite side and are hydraulically connected in parallel with one another. The heat-exchange passages of a flow-path section are, for example, arranged in a single tube, although an arrangement of the heat-exchange passages of a flow-path section which is distributed between a plurality of tubes is also conceivable.

Furthermore, the heat exchanger has an end piece with a tube plate which actually comprises a number of plates bearing against one another, namely a base plate, a diverter plate and a cover plate. The base plate can be connected to ends of the tubes by virtue of the base plate having, for example, cutouts, in which the tube ends can be received. Within the context of the invention, it is also conceivable to use other types of connection between tubes and the base plate, for example connections produced by extensions at the edges of cutouts in the base plate, so that the tubes can be plug-fitted onto the extensions. Cutouts in the diverter plate serve to form through-passages and/or diverter passages, which can be closed off in a fluid-tight manner with respect to an environment surrounding the heat exchanger by means of a cover plate. The plate structure of the tube plate allows the end piece and the entire heat exchanger to be of very pressure-stable construction.

A first basic idea of the invention is for the end piece which comprises the tube plate to be provided with a collection box which, in a housing, has at least one collection chamber for the first medium. In this way, a component which may in any case be required is integrated in the end piece, ensuring a compact and therefore simple design of the heat exchanger.

According to a second basic idea of the invention, flow-path sections are connected to one another by means of diverter passages in the diverter plate. The connection of the flow-path sections to form one or more hydraulically parallel flow paths can then be designed to satisfy any desired requirements, by virtue of a single plate, namely the diverter plate, being configured so as to correspond to the required flow-path connection. Therefore, the heat exchanger can be constructed flexibly for different applications, on account of its modular structure.

According to another basic idea of the invention, a tube is introduced into the tube plate as far as a predetermined stop in order to achieve increased manufacturing reliability and therefore simplified production. The stop is realized by a web between two cutouts in the base plate, which web can be received in a cutout in a tube end, with the width of the web being substantially equal to that of the cutout in the tube end. It is advantageous for the cutout to be slightly wider than the web, in order to facilitate insertion of the tube into the base plate. The depth of insertion of the tube is determined by the height of the cutout in the tube end. It is particularly advantageous for the cutout to be higher than the web, thereby reducing the risk of one or more heat-exchange passages undesirably becoming blocked by solder which is present on the base plate during a soldering process. The difference in height is, for example, 1 mm or more, but should on the other hand be less than the thickness of the diverter plate, since the tube otherwise butts against the cover plate. A height difference which is approximately equal to half the thickness of the diverter plate is advantageous.

A further basic concept of the invention is for a plurality of individual plates of the tube plate to be configured integrally, in order to reduce the number, the manufacturing costs and if appropriate the materials costs. Under certain circumstances, the tube plate then comprises just one individual plate, into which the base plate, the diverter plate and the cover plate are integrated.

According to a further concept of the invention, the outlay on material for the tube plate and therefore also for the heat exchanger is reduced by one or more individual plates, and preferably all the individual plates, of the tube plate having additional cutouts between through-passages and/or diverter passages, which cutouts are formed, for example, as apertures or lateral notches. It is advantageous for the plates to be fully separated between through-passages and/or diverter passages, which means that under certain circumstances the plates may be broken down into many small partial plates. This allows a particularly lightweight design which has beneficial effects both on materials costs and on the weight of the heat exchanger.

According to a further basic concept of the invention, a simplified structure is also made possible by tubes which are deformed in a U shape, in which case the tubes are deformed once or, to produce an even simpler design, more than once. As a result, two tube-plate connections and if appropriate a diverter passage are recessed in the region of the U-shaped deformation. If exclusively U-tubes are used, it is even possible to eliminate one end piece, if all the diversions on one side of the heat exchanger are realized by tube deformations. In this case, the ends of in each case one tube can be connected to the same base plate.

A further concept of the invention is for the heat exchanger to be provided with precisely one end piece, in which in particular a collection box having two collection chambers is integrated. This can be realized not only by using U-tubes but also by any conceivable hydraulic connection of tubes on the opposite side of the heat exchanger from the precisely one end piece, for example by fitting suitably constructed caps onto in each case a plurality of, in particular two, tubes.

Preferred embodiments of the heat exchanger according to the invention form the subject matter of the dependent claims.

According to a preferred embodiment, a collection box which is optionally integrated in the end piece is soldered or welded in a fluid-tight manner to the cover plate. According to another advantageous embodiment, the collection box is formed integrally with the cover plate, thereby simplifying production. A particularly lightweight design is achieved by a tubular design of the collection box in accordance with a further configuration of the invention. It is particularly preferable for the cover plate, at edges of apertures, to have extensions which engage in apertures in a housing of the collection box. Conversely, according to a further embodiment, it is possible for apertures in the collection box housing to be provided with extensions which engage in apertures in the cover plate. In both cases, manufacturing reliability is increased by aligning the flush apertures in the cover plate and in the collection-box housing.

According to one preferred embodiment, the through-openings which are formed by the flush apertures in the cover plate and in the collection-box housing have different cross sections of flow. This allows simple matching of the distribution of the first medium to the flow conditions in the associated collection chamber. In particular, a uniform distribution between a plurality of flow paths is desirable in this context, but a deliberately nonuniform distribution is also conceivable, for example in the case of a nonuniform mass flow of the second medium over an end face of the heat exchanger. It is advantageous for the through-openings with different cross sections of flow to be arranged upstream of the heat-exchange passages, making it particularly simple to equalize the flow in the flow paths. If quantitative flows through the flow paths are controlled on an inlet side for the first medium, it is possible to make the through-openings on the outlet side larger, for example with a cross section of flow which corresponds to the cross section of flow of the respective flow path. If the heat exchanger is used, for example, as an evaporator in a refrigerant circuit, the pressure ratios along the circuit are more advantageous for the overall performance of the heat exchanger if cross sections of flow are narrowed before the refrigerant is heated than if the cross sections of flow are narrowed after this heating.

According to one configuration, the cross sections of flow of the through-openings can be adapted to a pressure distribution of the first medium within the collection chamber in question. In another configuration, the cross sections of flow can be matched to a density distribution of the first medium within the collection chamber in question. In the context of the invention, the density of a medium in the case of single-phase media is to be understood as meaning the physical density, whereas in the case of multi-phase media, for example in the case of media which are partially liquid and partially gaseous, it is to be understood as meaning a density averaged over the volume in question.

For similar reasons, in a preferred embodiment the cross-sectional areas of the first and second collection chambers are different than one another. It is particularly preferable for it to be possible to adapt the cross-sectional areas of the collection chambers to the density ratios of the first medium in the chambers.

Further embodiments of the heat exchanger according to the invention relate to the connection of the flow-path sections by means of diverter passages in the diverter plate.

According to one advantageous configuration, flow-path sections which are arranged next to one another in the main direction of flow of the second medium are connected to one another by a diverter passage. This is then referred to as a diversion over the width. This makes it possible for a plurality of or possibly all flow-path sections within a row or within a tube row to be connected to one another to form a flow path. This leads to an at least partially serpentine design of the heat exchanger. In another configuration, the interconnected flow-path sections are aligned in the main direction of flow of the second medium. This is then known as a diversion over the depth. This makes it possible for flow paths for the first medium to be connected in parallel or antiparallel with the main direction of flow of the second medium. This leads to an at least partially countercurrent design of the heat exchanger.

According to a further embodiment, two flow-path sections within a tube are connected to one another by a diverter passage. This means that the first medium flows through the tube in one direction and flows back through the same tube in the opposite direction. The use of tubes with a large number of heat-exchange passages therefore reduces the total number of tubes and therefore the manufacturing costs.

According to one preferred configuration, the number of sections of at least one flow path can be divided by two. This means that it is easy to connect up a two-row arrangement of the flow-path sections, by virtue of the first half of the sections of a flow path being arranged in a first row and being connected to one another by diversions over the width, whereas the second half of the sections are arranged in a second row and are likewise connected to one another by diversions over the width, with the two halves of the flow path being connected by a diversion over the depth. This diversion over the depth takes place, for example, in a diverter passage of a diverter plate of a tube plate on the opposite side of the heat exchanger from the collection chambers. It is particularly preferable for the number of sections of the flow path to be divisible by four. This means that with a two-row arrangement of the flow-path sections connected up as described above, the diversion over the depth takes place on that side of the heat exchanger on which the collection chambers are located as well. As a result, it may be possible to configure just one diverter plate of the heat exchanger if the heat exchanger is designed for predetermined requirements, whereas other components are left unchanged.

In one configuration, the first and last flow-path sections within one or more tube rows are not acted on as hydraulically the first sections of flow paths, since the flow and/or pressure conditions of the first medium are unfavorable for application to flow paths in the edge region of collection chambers, which are usually arranged along tube rows.

According to an advantageous embodiment, two adjacent flow paths run mirror-symmetrically with respect to one another. It is particularly preferable for diverter passages of at least two flow paths to communicate. This results in additional compensation of the through-flow within the flow paths. With a mirror-symmetrical profile of the flow paths communicating with one another, communication between the then optionally adjacent diverter passages is particularly simple to realize, for example by omitting a web which may under certain circumstances otherwise be present between two diverter passages.

In a further preferred embodiment, a cross section of flow of a flow path changes over the course of its profile. This is very simple to realize, for example by flow-path sections with a small number of heat-exchange passages being connected, via correspondingly configured diverter passages, to flow-path sections with a large number of heat-exchange passages. It is particularly preferable to match the cross section of flow of one flow path to a density of the first medium which changes along the flow path.

A configuration in which all sections of at least one flow path are aligned with one another in the main direction of flow of the second medium is advantageous. It is particularly advantageous for all the flow paths of the heat exchanger to be designed in this way, so that a purely countercurrent construction of the heat exchange is made possible in a simple way, namely by correspondingly configured diverter passages in a diverter plate.

In a further embodiment, the heat exchanger comprises flat tubes which have a refrigerant in liquid and/or vapor form flowing through them, corrugated fins arranged between the flat tubes and acted on by ambient air, a collection and distribution device for supplying and discharging the refrigerant, the collection and distribution device comprising a plurality of interrupted plates which are layered on top of one another, so as to form refrigerant passages, with the ends of the flat tubes being held in receiving openings in a base plate, and a diverter device for diverting the refrigerant in the direction of flow of the ambient air, the heat exchanger comprising a series of flat tubes, with in each case one flat tube having two flow sections running parallel, through which medium flows in succession, these flow sections being connected by the diverter device, each flat tube, at the end side, having a groove between the two flow sections in the center of the flat-tube end, and the base plate, between the receiving openings, having webs, the dimensions of which, in terms of height and width, corresponding to the grooves, so as in each case to form a joined connection to the grooves.

It is particularly preferable for the diverter device to be formed by a further base plate with receiving openings and webs which form a joined connection to the end-side groove of the flat tubes.

It is particularly preferable for the diverter device additionally to have a passage plate with continuous slots and a closed cover plate.

It is particularly preferable for the collection and distribution device to have a passage plate with passage openings and webs between the passage openings, a cover plate with refrigerant inlet and outlet openings and a refrigerant feed and refrigerant discharge passage, which are arranged parallel to one another and in the longitudinal direction of the heat exchanger, with the base plate, the passage plate and the cover plate being arranged above one another in such a manner that the openings in the plates are aligned with the flat-tube ends.

It is particularly preferable for the refrigerant inlet openings to be designed as calibrated bores, with the diameter of the bores in particular being variable. It is also preferable for the cover plate and the refrigerant feed and discharge passages to be of single-part design.

According to a further configuration, the heat exchanger, which can be used in particular as an evaporator for motor vehicle air-conditioning systems, comprises flat tubes which have a refrigerant in liquid and/or vapor form flowing through them, corrugated fins arranged between the flat tubes and acted on by ambient air, a collection and distribution device for supplying and discharging the refrigerant, the collection and distribution device comprising a plurality of interrupted plates layered on top of one another, so as to form refrigerant passages, with the ends of the flat tubes being held in receiving openings in a base plate, and a diverter device for diverting the refrigerant in the direction of flow of the ambient air. The heat exchanger in this case comprises a row of flat tubes, with in each case one flat tube having two flow sections which run parallel, through which medium can flow in succession and which are connected via the diverter device, and the collection and distribution device having a calibration device which is arranged between refrigerant inlet and refrigerant outlet and is designed as a cover plate with calibration openings for the refrigerant distribution. It is preferable for the calibration openings to be arranged on the refrigerant inlet side.

According to an advantageous refinement, the calibration openings have different cross sections of flow. The cross sections of flow of the calibration openings preferably increase in size in the direction of the pressure drop of the refrigerant in the feed passage. It is particularly preferable for the cross sections of flow of the calibration openings to be variable as a function of the specific volume of the refrigerant and/or its vapor content.

In another embodiment of the heat exchanger, the flat tubes are designed as serpentine segments, and the diverter device is arranged in the collection and distribution device.

According to a further configuration, the collection and distribution device has a passage plate with continuous passage openings for diverting the refrigerant, and passage openings with webs, a cover plate with refrigerant inlet and outlet openings and a refrigerant feed passage and a refrigerant discharge passage. The passage openings with webs are in this case each arranged flush with the first flat-tube end of the serpentine segment, whereas the continuous passage openings are arranged flush with the second flat-tube end of the serpentine segment, the refrigerant inlet and outlet openings being flush with the passage openings, and the continuous passage openings being covered by the cover plate. It is preferable for the serpentine segments to have two or three diversions over the width.

According to an advantageous embodiment of the heat exchanger, the flat tubes are designed as U-tubes, i.e. with in each case one diversion (over the width). It is preferable for in each case two U-tubes to be connected in series on the refrigerant side, and for in each case two adjacent passage openings, which are assigned to a U-tube outlet and a U-tube inlet, to be in refrigerant communication with one another through a transverse passage in the passage plate.

It is preferable for the width b of the passage openings in the passage plate to be greater than the width a of the receiving openings in the base plate. It is also advantageous for the depth of the groove in the flat-tube ends to be greater than the thickness of the base plate.

It is advantageous for one or more of the following dimensional stipulations to apply to the heat exchanger:

| | |
|---|---|
| Width: | 200 to 360 mm, in particular 260 to 315 mm, |
| Height: | 180 to 280 mm, in particular 200 to 250 mm |

-continued

| | |
|---|---|
| Depth: | 30 to 80 mm, preferably 35 to 65 mm |
| Volume: | 0.003 to 0.006 $m^3$, in particular 0.0046 $m^3$ |
| Number of tubes per refrigerant path: | 1 to 8, preferably 2 to 4 |
| Diameter of the heat-exchange passages: | 0.6 to 2 mm, in particular 1 to 1.4 mm |
| Center-to-center distance of the heat-exchange passages in the depth direction: | 1 to 5 mm, preferably 2 mm |
| Transverse pitch: | 6 to 12 mm, in particular 10 mm |
| Tube height: | 1 to 2.5 mm, in particular 1.4 to 1.8 mm |
| End face surface area SF in the main direction of flow of the second medium: | 0.04 to 0.1 $m^2$, in particular 0.045 to 0.07 $m^2$ |
| Free flow cross-sectional area BF for the second medium: | 0.03 to 0.06 $m^2$, in particular 0.053 $m^2$ |
| Ratio BF/SF: | 0.5 to 0.9, in particular 0.75 |
| Heat-exchanging surface area: | 3 to 8 $m^2$, in particular 4 to 6 $m^2$ |
| Lamella density for corrugated fins: | 400 to 1000 $m^{-1}$, in particular 650 $m^{-1}$ |
| Passage height: | 4 to 10 mm, in particular 6 to 8 mm |
| Lamella slot length: | 4 to 10 mm, in particular 6.6 mm |
| Lamella slot height: | 0.2 to 0.4 mm, in particular 0.26 mm |
| Thickness of the base plate: | 1 to 3 mm, in particular 1.5 or 2 or 2.5 mm |
| Thickness of the diverter plate: | 2.5 to 6 mm, in particular 3 or 3.5 or 4 mm |
| Thickness of the cover plate: | 1 to 3 mm, in particular 1.5 or 2 or 2.5 mm |
| Collection box diameter: | 4 to 10 mm, in particular 6 to 8 mm |
| Housing wall thickness of a collection box: | 1 to 3 mm, in particular 1.5 to 2 mm |

BRIEF DESCRIPTION OF THE DRAWINGS

The invention is explained in more detail below on the basis of exemplary embodiments and with reference to the drawings, in which.

DETAILED DESCRIPTION OF PREFERRED EMBODIMENTS

Figure 1:
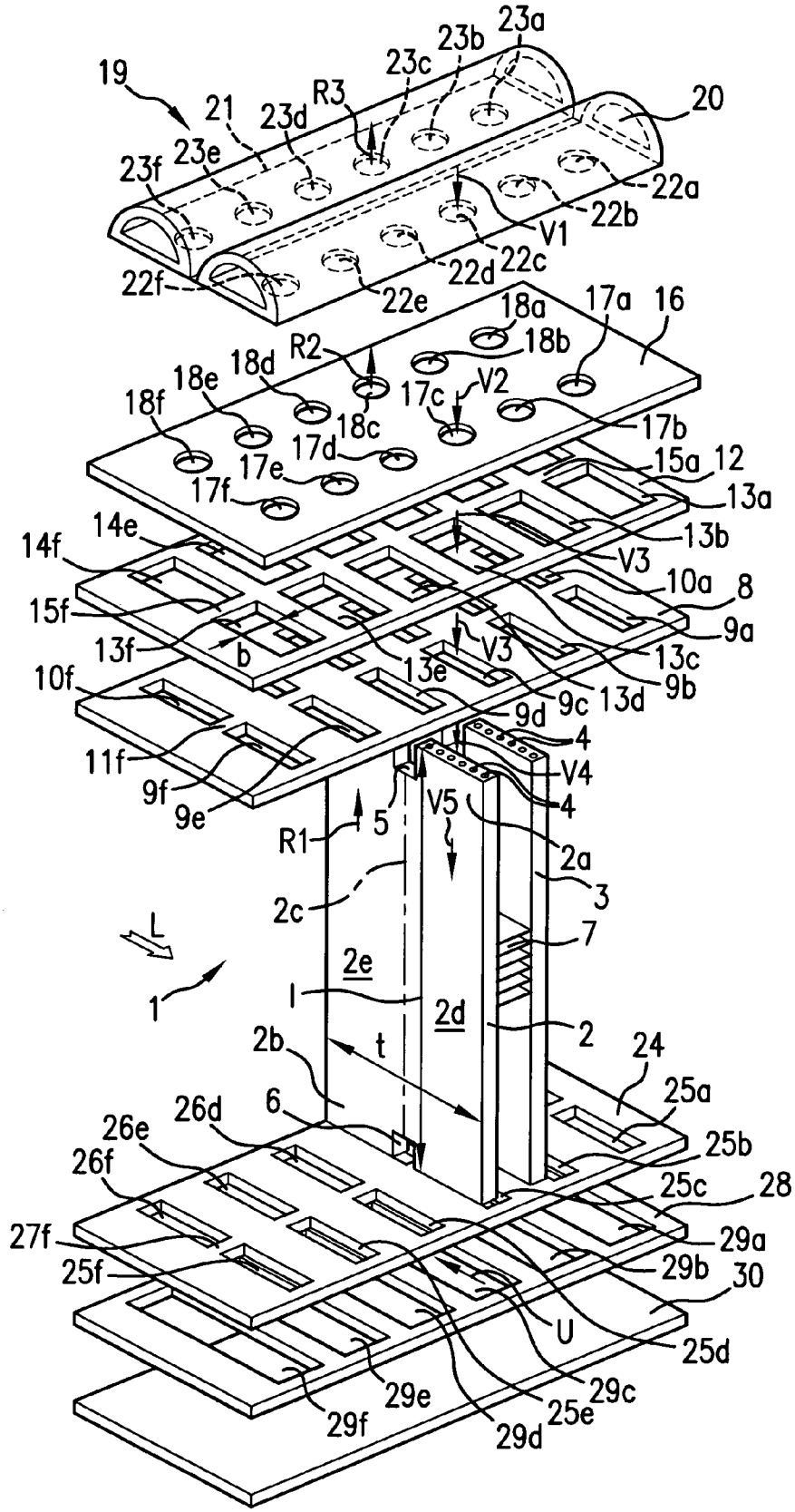
FIG. 1 shows a parallel-flow evaporator in the form of an exploded illustration.

FIG. 1 shows, as first exemplary embodiment, an evaporator for a motor vehicle air-conditioning system which is operated with $CO_2$ as refrigerant, specifically in the form of an exploded illustration. This evaporator 1 is designed as a single-row flat-tube evaporator and has a multiplicity of flat tubes, of which just two flat tubes 2, 3 are illustrated. These flat tubes 2, 3 are designed as extruded multichamber flat tubes which have a multiplicity of flow passages 4. All the flat tubes 2, 3 have the same length I and the same depth t. A groove 5, 6 is machined into the flat tube 2 at each tube end 2*a*, 2*b*, symmetrically with respect to the center axis 2*c*. Between the individual flat tubes 2, 3 there are corrugated fins 7, which are acted on by ambient air in the direction of the arrow L. The corrugated fins 7 are continuous in the depth direction, although they may also be interrupted, for example in the center of the depth t, in order to ensure improved condensate run-off and/or thermal isolation.

In the drawing, a base plate 8, in which a first row of slot-like apertures 9*a*-9*f* and a second row of similar apertures 10*a*-10*f* are arranged, is illustrated above the flat tubes 2, 3. The openings 9*a* and 10*a*, 9*b* and 10*b*, etc. are located one behind the other in the depth direction (airflow direction L) and in each case leave between them webs 11*a*, 11*b*-11*f*. In terms of their width in the depth direction, these webs 11*a*-11*f* correspond to the width of the cutout 5 of the tube ends 2*a*. The number of openings 9*a*-9*f* and 10*a*-10*f* corresponds to the number of flat tubes 2, 3.

What is known as a diverter plate 12, in which two rows of apertures 13*a*-13*f* and 14*a*-14*f* (partially covered) are arranged, is illustrated above the base plate 8 in the drawing. The arrangement of the apertures 13*a*-*f* and 14*a*-*f* corresponds to the arrangement of the apertures 9*a*-9*f* and 10*a*-10*f*, respectively, but the width b and depth of the apertures 13*a*-*f* and 14*a*-*f* are greater than the corresponding dimensions of the apertures 9*a*-9*f* and 10*a*-10*f*, respectively, which in each case only have a width a corresponding to the thickness of the flat tubes 2, 3. Webs 15*a*-15*f* are in each case left between the apertures 13*a*, 14*a*, 13*b*, 14*b*-13*f* and 14*f*. The dimensions of these webs 15*a*-15*f* in the depth direction are smaller than the corresponding dimensions of the webs 11*a*-11*f* of the base plate 8.

What is referred to as a cover plate 16, which includes a first row of refrigerant inlet apertures 17*a*-17*f* and a second row of refrigerant outlet apertures 18*a*-18*f*, is illustrated in the drawing above the diverter plate 12. These apertures 17*a*-17*f* and 18*a*-18*f* are preferably designed as circular bores with a diameter matched to the desired refrigerant distribution and quantitative flow.

Finally, a collection box 19 with a housing and in each case one collection chamber 20, 21 for supplying and discharging the refrigerant is located above the cover plate 16 in the drawing. The collection box has apertures 22*a*-*f* and 23*a*-*f*, illustrated by dashed lines, the position and size of which correspond to the apertures 17*a*-*f* and 18*a*-*f*, at the underside of both collection chambers.

In the drawing, a further base plate 24, which analogously to the first base plate 8 has two rows of slot-like apertures 25*a*-*f* and 26*a*-*f*, is illustrated beneath the flat tubes 2, 3 in the drawing. Between the apertures 25*a* and 26*a* to 25*f* and 26*f* there are likewise webs 27*a*-*f* (partially covered), the width of these webs in the depth direction corresponding to the width of the cutout 6 in the end of the flat tube 2. A further diverter plate 28, which has continuous diverter passages 29*a*-29*f*, is illustrated in the drawing below the second base plate 24. These diverter passages 29*a*-*f* extend over the entire depth t of the flat tubes 2, 3.

Finally, a cover plate 30, which does not have any apertures, but rather closes off the diverter passages 29*a*-29*f* with respect to the environment surrounding the heat exchanger, is illustrated at the bottom of the drawing.

The above-described individual parts of the evaporator 1 are assembled in the following way: the base plate 8 is fitted onto the flat-tube ends 2*a*, etc., so that the webs 11*a*-11*f* come to lie in the cutouts 5 in the flat-tube ends. Then, the diverter plate 12, the cover plate 16 and the collection box 19 with the collection chambers 20, 21 are stacked on top of the base plate 8. In a similar way, the lower base plate 24 is pushed onto the flat-tube ends 2*b*, so that the webs 27*a*-27*f* come to lie in the cutouts 6; then, the passage plate 28 and the cover plate 29 are attached. After the evaporator 1 has therefore been assembled, it is soldered to form a fixed block in a soldering furnace. During the soldering process, the plates are held in position with respect to one another by a positive or nonpositive clamping action. However, it is also possible firstly to assemble the end piece comprising base plate, diverter plate and cover plate, and then to connect it to flat tubes.

The profile of the refrigerant flow is illustrated by way of example on the basis of a row of arrows V1-V5 on the front side of the evaporator, by the diverter arrow U in the diverter passage 29*c* and the arrows R1, R2 and R3 on the rear side of the evaporator 1. The refrigerant, in this case therefore $CO_2$, thus flows through the evaporator, starting on the front side from the top downward, specifically in the front section 2*d* of the flat tube 2, is diverted over the depth in the lower tube plate, comprising the individual plates 24, 28, 30, and flows from the bottom upward on the rear side of the evaporator 1, i.e. in the rear flow section 2*e* of the flat tube 2, as indicated by the arrows R1, R2 and R3, into the collection chamber 21.

Figure 2:
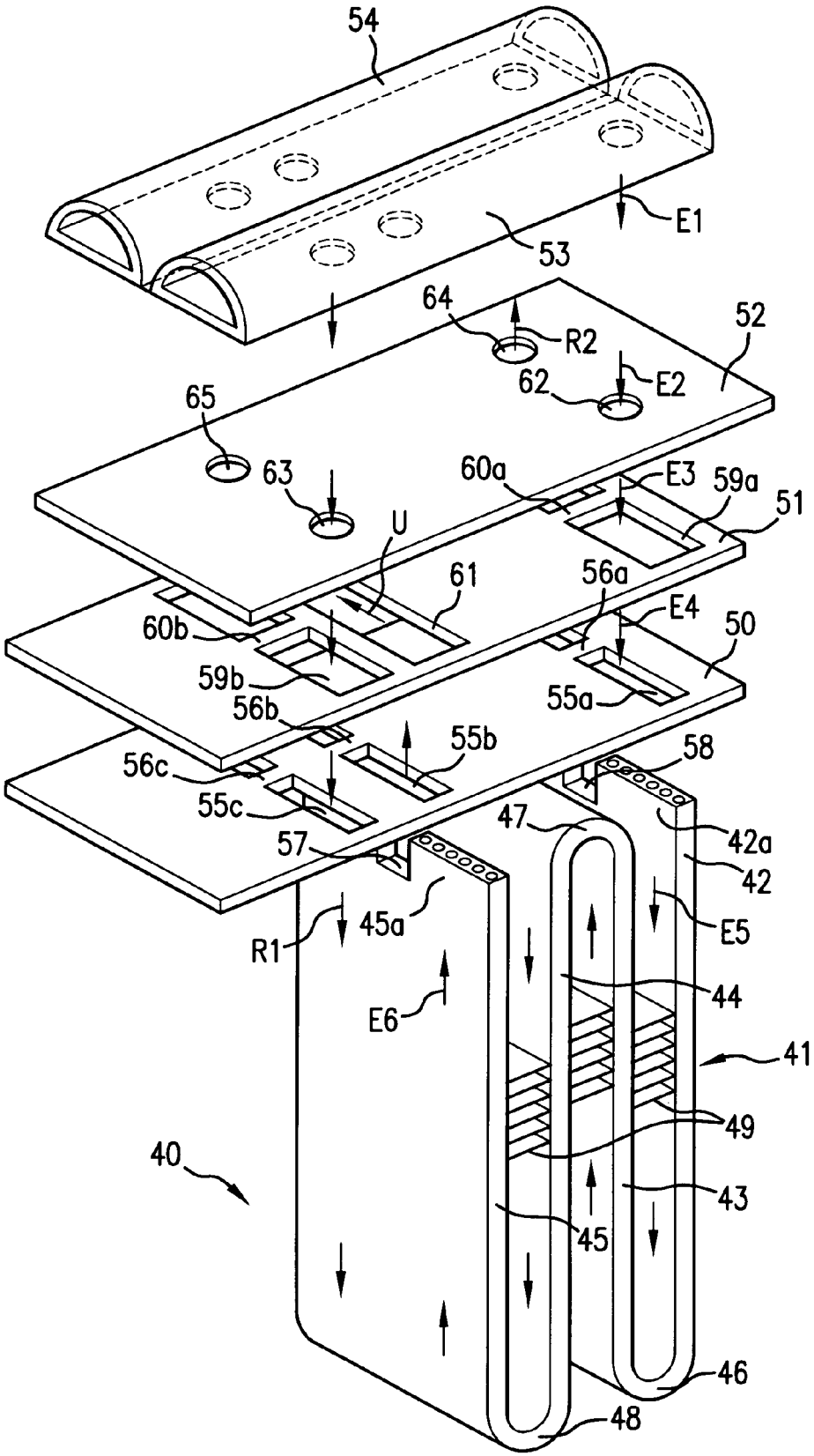
FIG. 2 shows an evaporator with serpentine segment (diversion over the width)

FIG. 2 shows a further exemplary embodiment of the invention, specifically an evaporator 40 in which the above-mentioned flat tubes are designed as serpentine segments 41. A serpentine segment 41 of this type comprises four flat-tube limbs 42, 43, 44 and 45, which are connected to one another by three diverter bends 46, 47, 48. Corrugated fins 49 are arranged between the individual flat-tube limbs 42-45. The further parts of the evaporator are likewise illustrated in the form of an exploded illustration, i.e. a base plate 50, a diverter plate 51, a cover plate 52 and collection chambers 53, 54 for a refrigerant feed and discharge. The base plate 50 has a front row of slot-like apertures 55*a*, 55*b* and 55*c*, behind which there is a second row (partially covered) of corresponding apertures. Webs 56*a*, 56*b* and 56*c* are in turn left between the two rows of apertures, these webs corresponding with cutouts 57 and 58 in the ends 42*a* and 45*a* of the serpentine segment 41. These flat-tube ends are therefore fitted through the apertures in the base plate, with the webs coming to lie in the cutouts. The base plate 50 is followed at the top by the diverter plate 51, which has an aperture 59*a* which is flush with the aperture 55*a* in the base plate 50. Behind the aperture 59*a* in the depth direction there is (partially covered) a corresponding aperture, which is separated from the aperture 59*a* by a web 60*a*. This web 60*a* is once again smaller than the cutout 58 in the flat-tube limb 42. Adjacent to the aperture 59*a*, at a distance which corresponds to the distance between the flat-tube ends 42*a*-45*a*, there is a diverter passage 61 which extends over the entire depth of the flat-tube limb 45. Adjacent to the diverter passage 61 there then follows an aperture 59*b*, the size of which corresponds to the aperture 59*a*. It corresponds to the next flat-tube serpentine segment, which is not shown here. Above the diverter plate 51 is the cover plate 52, which in the front row has two refrigerant feed apertures 62, 63 and in the rear row has two refrigerant outlet apertures 64 and 65. The size and position of the latter correspond to the openings shown in dashed lines in the drawing (without any reference numbers) at the collection chambers 53, 54.

The refrigerant flow route is illustrated by arrows: first of all the refrigerant leaves the collection chamber 53 as indicated by the arrow E1, then follows the direction of the arrows E2, E3, E4 and passes into the front flow section of the flat-tube limb 42 and then flows through the entire serpentine segment 41 on its front side and emerges from the final limb 45 at E6, passes into the diverter passage 61, where it is diverted over the depth in accordance with arrow U, before then flowing through the rear side of the serpentine segment, as indicated by arrow R1, i.e. in the opposite direction to on the front side. Finally, this stream of refrigerant passes into the collection chamber 54 as indicated by the arrow R2, i.e. through the aperture 64.

This construction therefore diverts the refrigerant over the width of the evaporator, i.e. transversely to the main direction of flow of the air, specifically initially from the right to the left on the front side in the drawing, and then from the left to the right on the rear side. As has already been mentioned above, one or more serpentine segment sections which are not illustrated follow the serpentine segment section 41 illustrated in the drawing.

FIG. 2 illustrates just one serpentine segment section 41, arranged on the right in the drawing. Contrary to the description given above, it is possible for the next serpentine segment section following this serpentine segment section 41 also to have refrigerant flowing through it in the opposite direction over the width, i.e. from the left to the right or from the outside inward in the drawing. On viewing the end face of the evaporator, therefore, the latter would therefore have refrigerant flowing through it symmetrically from the outside inward on the front side, then the two refrigerant streams can then be combined in the center—in a common diverter passage which then functions as a mixing space—and diverted over the depth and can flow from the inside back outward on the rear side.

Figure 3:
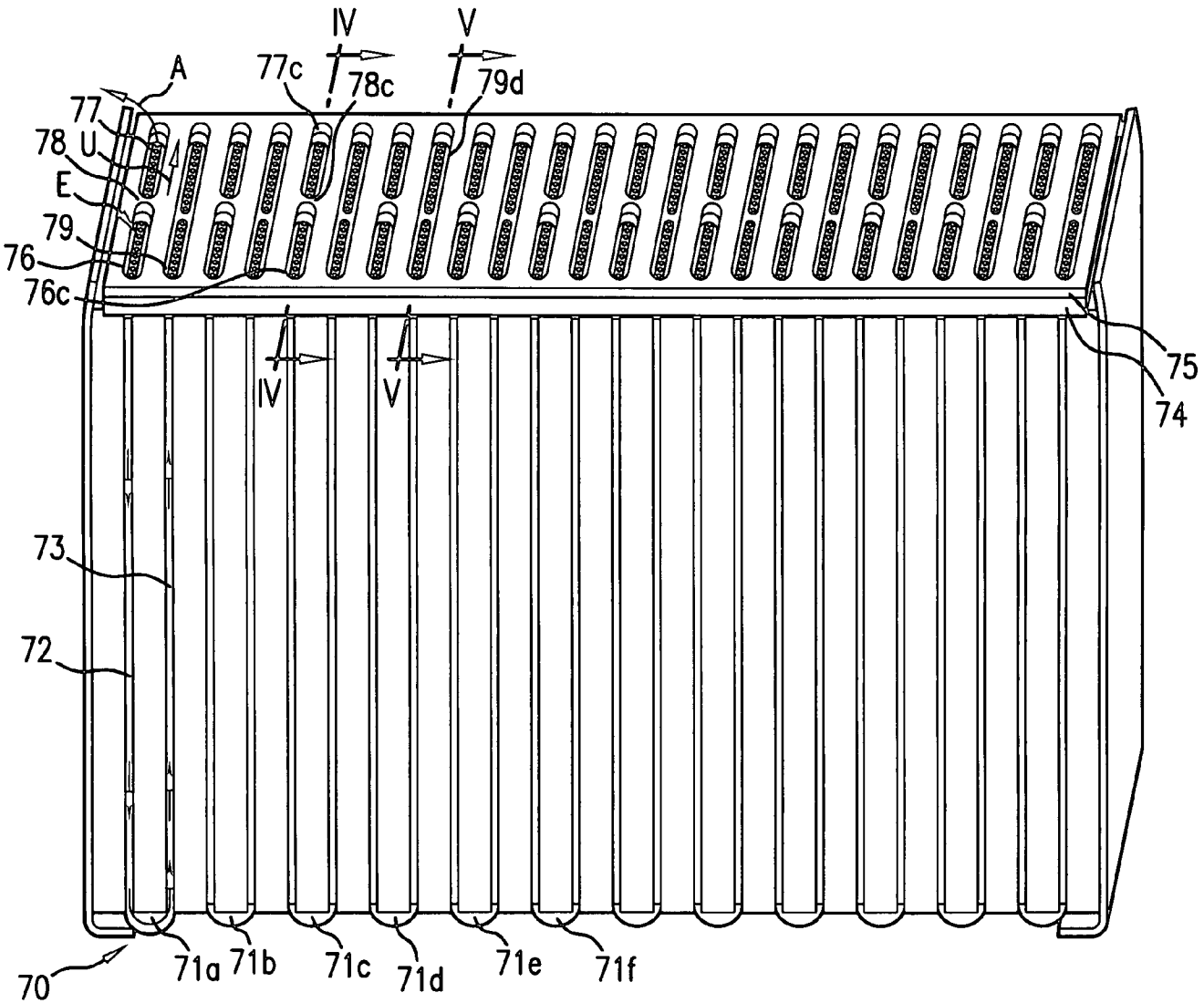
FIG. 3 shows an evaporator with U-tubes.

FIG. 3 shows a further exemplary embodiment of the invention, specifically an evaporator 70, the flat tubes of which are formed from individual U-tubes 71*a*, 71*b*, 71*c* etc. This is therefore a serpentine segment section with a diversion and two limbs 72 and 73. The ends of these flat-tube limbs 72 and 73 which cannot be seen in the drawing are secured in an analogous way, i.e. as described above, in a base plate 74 with corresponding receiving parts. A diverter plate 75 is arranged above the base plate 74 and has, in alternation, two slot-like apertures 76, 77 which lie one behind the other in the depth direction, leaving a web 78 and a diverter passage 79 which continues through in the depth direction. In this illustration, the cover plate—similar to the exemplary embodiments described above—has been omitted.

The flow of the refrigerant then follows the direction of the arrows, i.e. the refrigerant enters the front flow section of the U-tube 71*a* at E, initially flows downward, is diverted at the bottom, then flows upward and passes into the diverter passage 79, where it is diverted as indicated by arrow U before then flowing downward on the rear side, where it is diverted and then flows upward again in order to pass through the aperture 77 as indicated by arrow A. The supply and discharge of the refrigerant is described on the basis of the following figure, corresponding to sections IV-IV and V-V.

Figure 4:
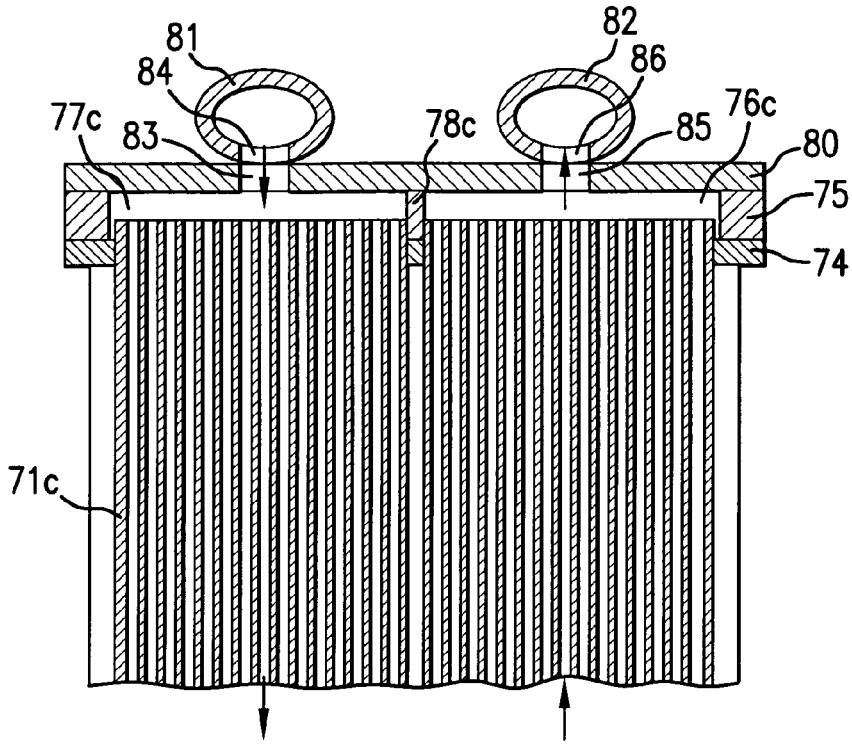
FIG. 4 shows a section IV-IV through evaporators as shown in FIG. 3.

FIG. 4 shows a section on line IV-IV through the evaporator shown in FIG. 3, in the form of an enlarged illustration and with the addition of a cover plate 80 and a collection box 81 and a collection box 82. The other parts are denoted by the same reference numerals as in FIG. 3, i.e. the diverter plate by 75, the base plate by 74 and the flat-tube limb by 71*c*. The diverter plate 75 has two apertures 76*c* and 77*c*, which are separated from one another by the web 78*c*. In the cover plate 80 there is a refrigerant inlet aperture 83, which is arranged flush with a refrigerant aperture 84 in the collection box 81. In a similar way, a refrigerant outlet aperture 85 in the cover plate 80 is arranged flush with a refrigerant aperture 86 in the collection box 82 on the side of the collection box 82. The collection boxes 81, 82 are soldered tightly and in a pressure-resistant manner to the cover plate 80, as are the other parts 80, 75, 74 and 71*c*.

Figure 5:
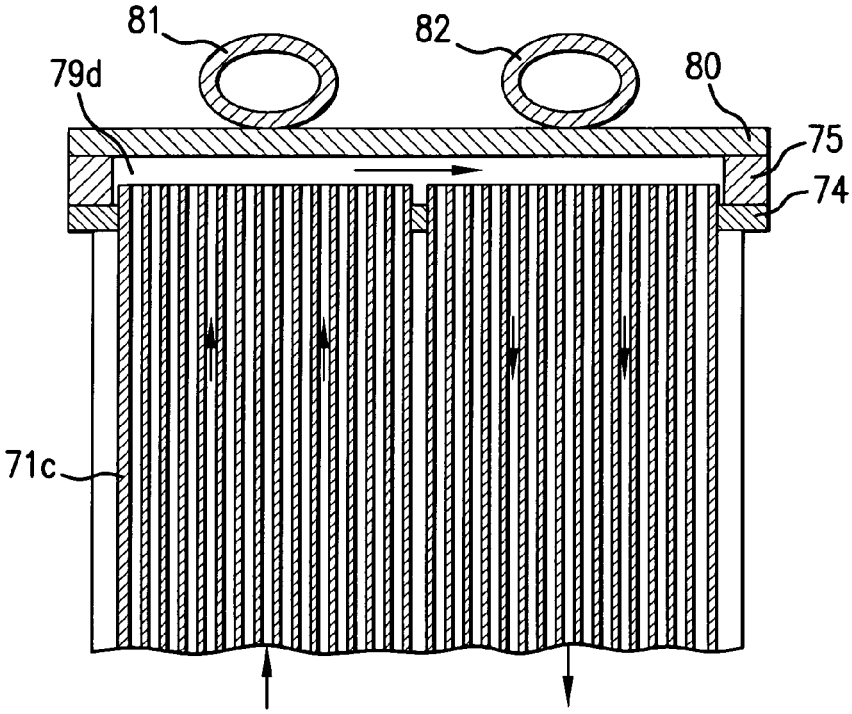
FIG. 5 shows a section V-V through evaporators as shown in FIG. 3.

FIG. 5 shows a further section, on line V-V in FIG. 3, i.e. through the diverter passage 79*d*. Identical parts are once again denoted by identical reference numerals. It can be seen that the refrigerant, illustrated by the arrows, flowing from the bottom upward in the left-hand flat-tube section, is diverted to the right in the diverter passage 79*d* and passes into the right-hand or rear section of the flat-tube limb 71*c*, where it flows from the top downward.

This mode of design of the evaporator shown in FIGS. 3, 4 and 5 with simple U-tubes therefore in each case allows simple diversion over the width and over the depth.

Figure 6:
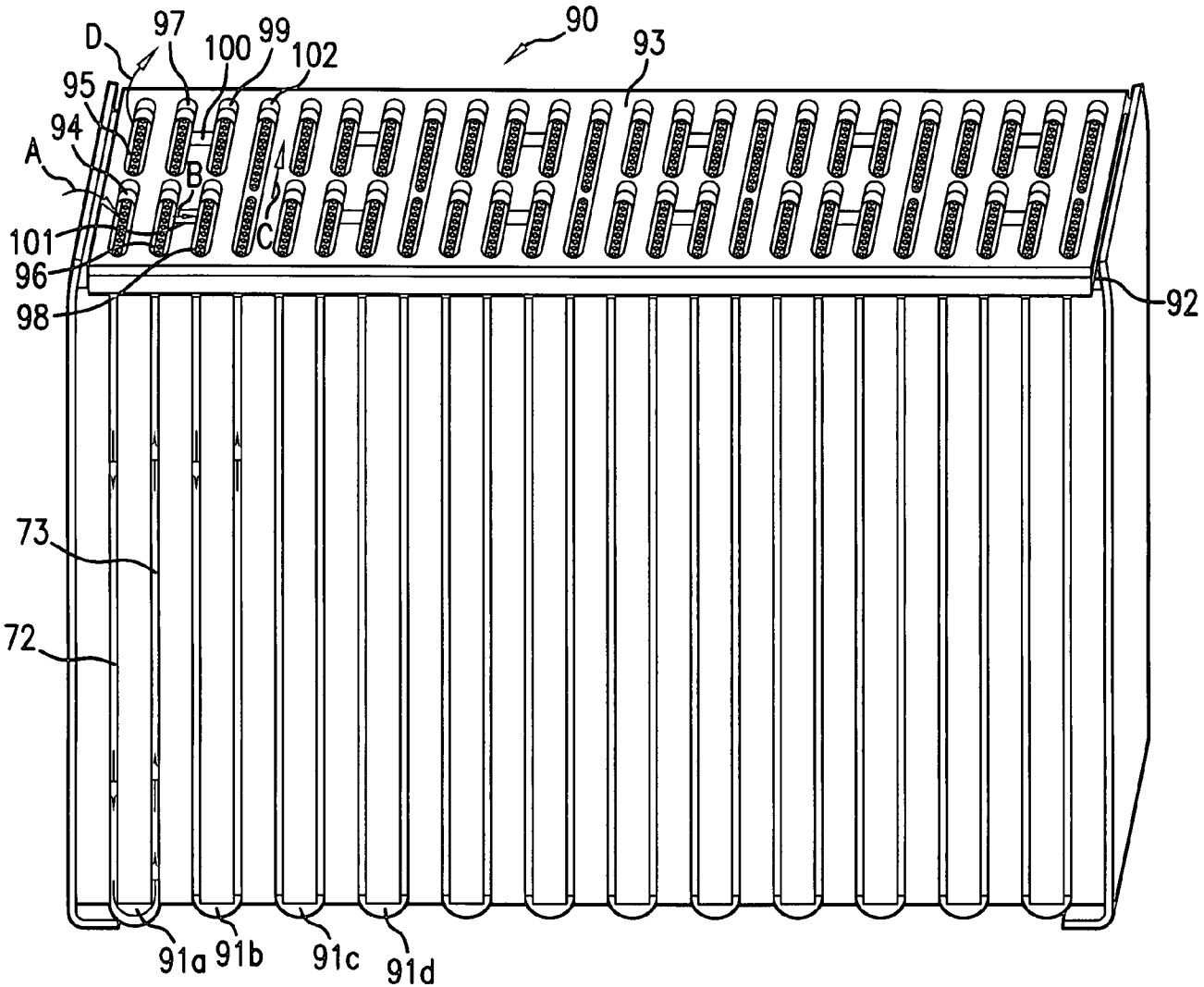
FIG. 6 shows an evaporator with U-tubes connected in series (diversion over the width)

FIG. 6 shows, as a further exemplary embodiment of the invention, an evaporator 90, which is once again constructed from U-tubes 91*a*, 91*b*, 91*c*, etc. The ends of the U-tube limbs are once again—although this is not illustrated in the drawing—received in a base plate 92, above which there is a diverter plate 93. The diverter plate 93 has a configuration of apertures in which a pattern repeats itself after in each case two U-tubes, i.e. for example 91*a* and 91*b*. The following text describes this pattern, specifically starting in the top left-hand corner of the drawing: two apertures 94 and 95 arranged one behind the other in the depth direction are located there, adjoined in the width direction by the apertures 96 and 97 and 98 and 99, the apertures 96 and 98, in the width direction, being in refrigerant communication via a transverse passage 101, and the apertures 97 and 99 being in refrigerant communication via a transverse passage 100, resulting in two H-shaped apertures. A continuous diverter passage 102 is arranged adjacent to the H-shaped apertures. The pattern of apertures 94-102 which has just been described is then repeated. This configuration of apertures enables in each case two U-shaped refrigerant tubes to be connected in series on the refrigerant side, i.e. in this case the U-tubes 91*a* and 91*b*. The refrigerant profile is illustrated by arrows: the refrigerant enters the front part of the left-hand limb of the U-tube 91*a* at A and flows downward, is diverted, flows back upward and is diverted into the next U-tube 91*b* in the diverter plate 93 via the transverse passage 101, i.e. following the arrow B. In this next U-tube 91*b*, it flows downward, is diverted, then flows back upward and passes into the diverter passage 102, where, following arrow C, it is diverted over the depth and then flows through the rear part of the two flat-tube limbs 91*b* and 91*a*, before finally emerging again at D. The cover plate and the refrigerant feed and discharge have been omitted here in order to provide a better illustration of the flow of refrigerant. This series connection of two U-tubes on the one hand allows triple diversion over the width and on the other hand means that each U-tube limb is received in the base plate, resulting in a pressure-stable design. Of course, this pattern can also be used to realize four or more diversions over the width, which merely requires U-shaped flat tubes. The upper diversion therefore in each case takes place in the passage plate 93.

FIG. 1 illustrates collection chambers 20 and 21, and FIG. 4 illustrates collection boxes 81 and 82, for supplying and discharging refrigerant. According to one refinement of the invention, it is possible for a distribution device in accordance with DE 33 11 579 A1, i.e. a coiled profiled-section body, or in accordance with DE 31 36 374 A1 in the name of the present Applicant, known as a push-in body, to be used in particular on the respective refrigerant inlet side, so that a uniform refrigerant distribution and therefore also a uniform temperature distribution is achieved at the evaporator. In this context, it may be advantageous if in each case a plurality of, for example four, adjacent refrigerant inlet apertures are supplied via a common chamber; this enables four times five, i.e. 20, refrigerant inlet apertures to be supplied with refrigerant in the case of a profiled-section body with, for example, five passages. For this purpose, the (five) passages, which initially run axially parallel, are in each case turned (through approximately 72°) behind a group of refrigerant inlet apertures, so that the adjacent chamber comes into communication with the next group of refrigerant inlet apertures.

Figure 7:
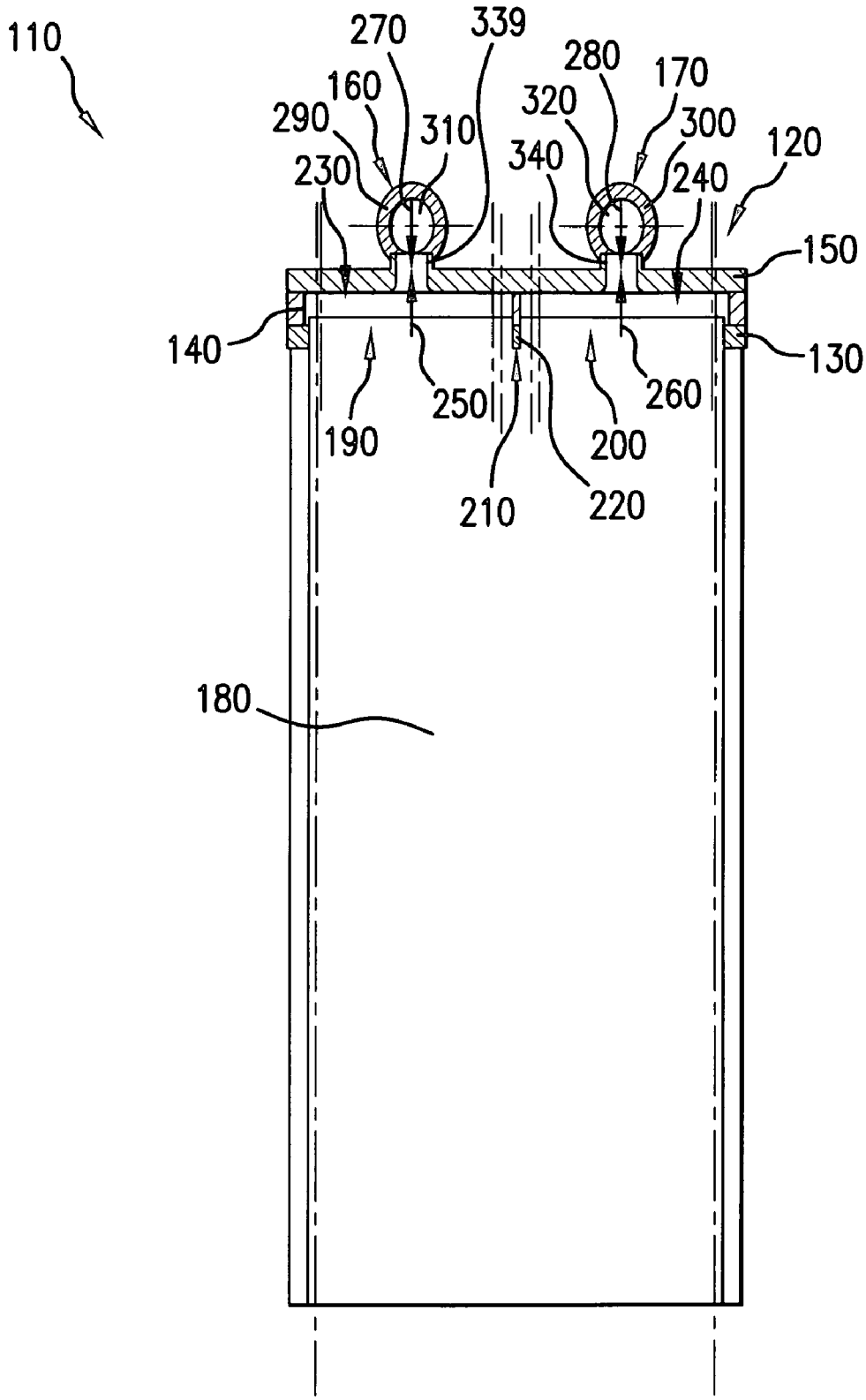
FIG. 7 shows a cross-sectional illustration of a heat exchanger.

FIG. 7 shows a cross section through a heat exchanger 110 with an end piece 120, which has a base plate 130, a diverter plate 140, a cover plate 150 and collection boxes 160, 170. A tube 180 is received in two apertures 190, 200 in the base plate 130, with a cutout 210 in one end of the tube 180 bearing against a web 220 of the base plate 130. The cutout 210 is slightly higher than the web 220, so that the tube end projects slightly above the base plate 130. Heat-exchange passages (not shown) in the tube 180 communicate with through-passages 230, 240 in the diverter plate 140. The through-passages 230, 240 are in turn connected via cutouts 250, 260 in the cover plate 150 and cutouts 270, 280 in the housings 290, 300 of the collection boxes 160, 170 to collection chambers 310, 320. To improve manufacturing reliability, the edges of the cutouts 250, 260 are provided with extensions 330, 340 which engage into the cutouts 270, 280, resulting in an orientation of the collection boxes 160, 170 with respect to the cover plate 150, in such a manner that the cutouts 250 and 260 in the cover plate 150 are flush with the cutouts 270 and 280, respectively, in the collection-box housings 290, 300.

Figure 8:
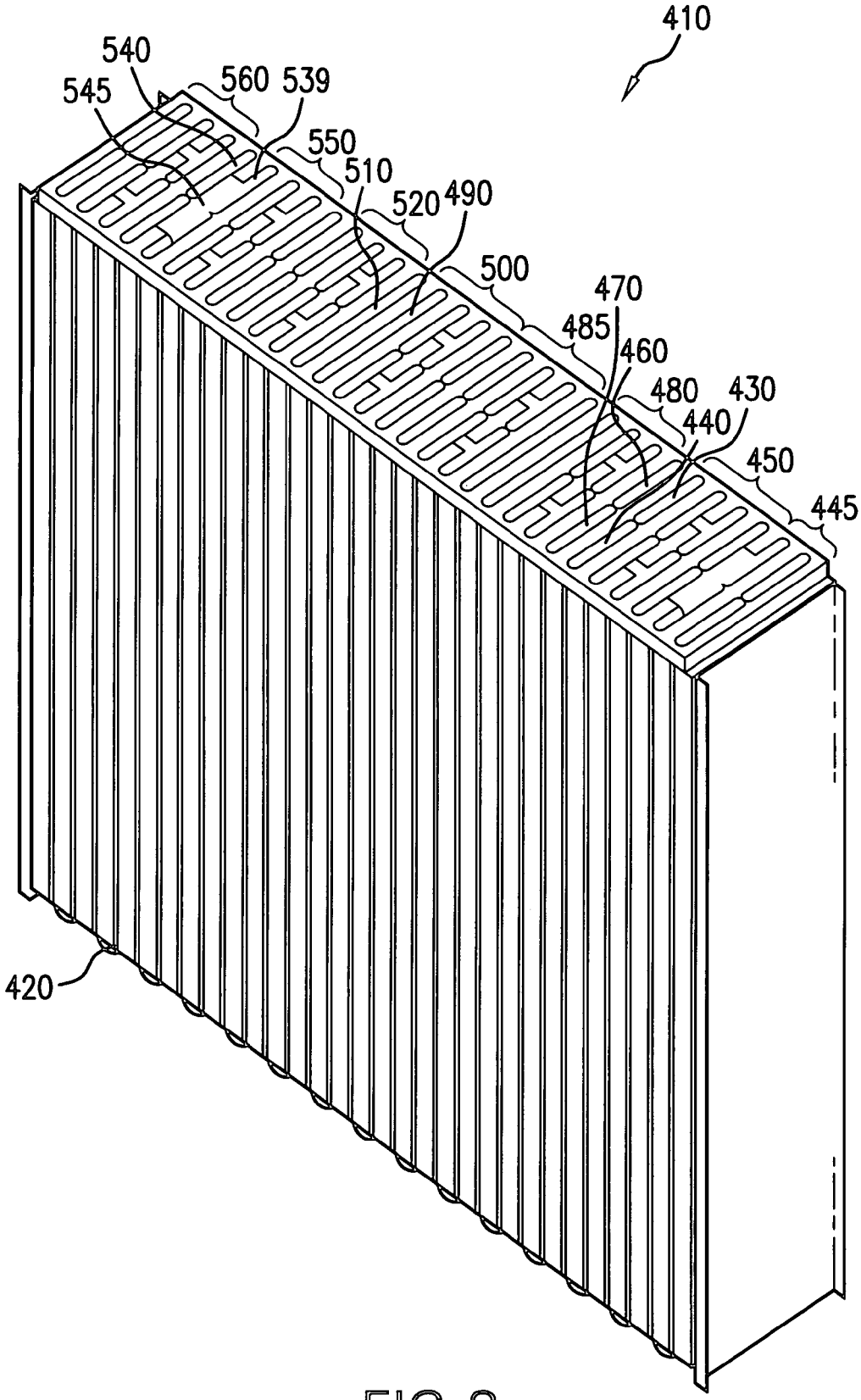
FIG. 8 shows a partial view of a heat exchanger.

FIG. 8 shows a refinement of the heat exchanger from FIG. 6. In the heat exchanger 410, the configuration of diverter passages likewise adopts a pattern which repeats itself after in each case two U-tubes 420, corresponding to a flow path through the heat exchanger 410. In this case, however, in each case two adjacent flow paths are arranged mirror-symmetrically with respect to one another. This means that either the through-passages 430, 440 of a flow path 450 come to lie next to the through-passages 460, 470 of an adjacent flow path 480, or a diverter passage 490 of a flow path 500 comes to lie next to a diverter passage 510 of an adjacent flow path 520. In the latter case, it is possible for the adjacent diverter passages 530, 540 to be connected to a connecting passage 545, so that mixing and flow compensation is realized between the participating flow paths 550, 560. This is particularly effective in a region of the edge of the heat exchanger, since the flow conditions there may otherwise be particularly unfavorable for the performance of a heat exchanger. In other regions of the heat exchanger, mixing of the first medium by means of a connection passage between two adjacent diverter passages is also possible. The flow paths 450, 480, 485, 500, 520, 550, 560 in each case comprise eight sections, whereas the flow path 445 comprises just four sections, in order to reduce a pressure drop along the flow path 445, likewise on account of the unfavorable flow conditions in the edge regions of a heat exchanger. In this case, mixing with the adjacent flow path 450 is likewise applied.

Figure 9:
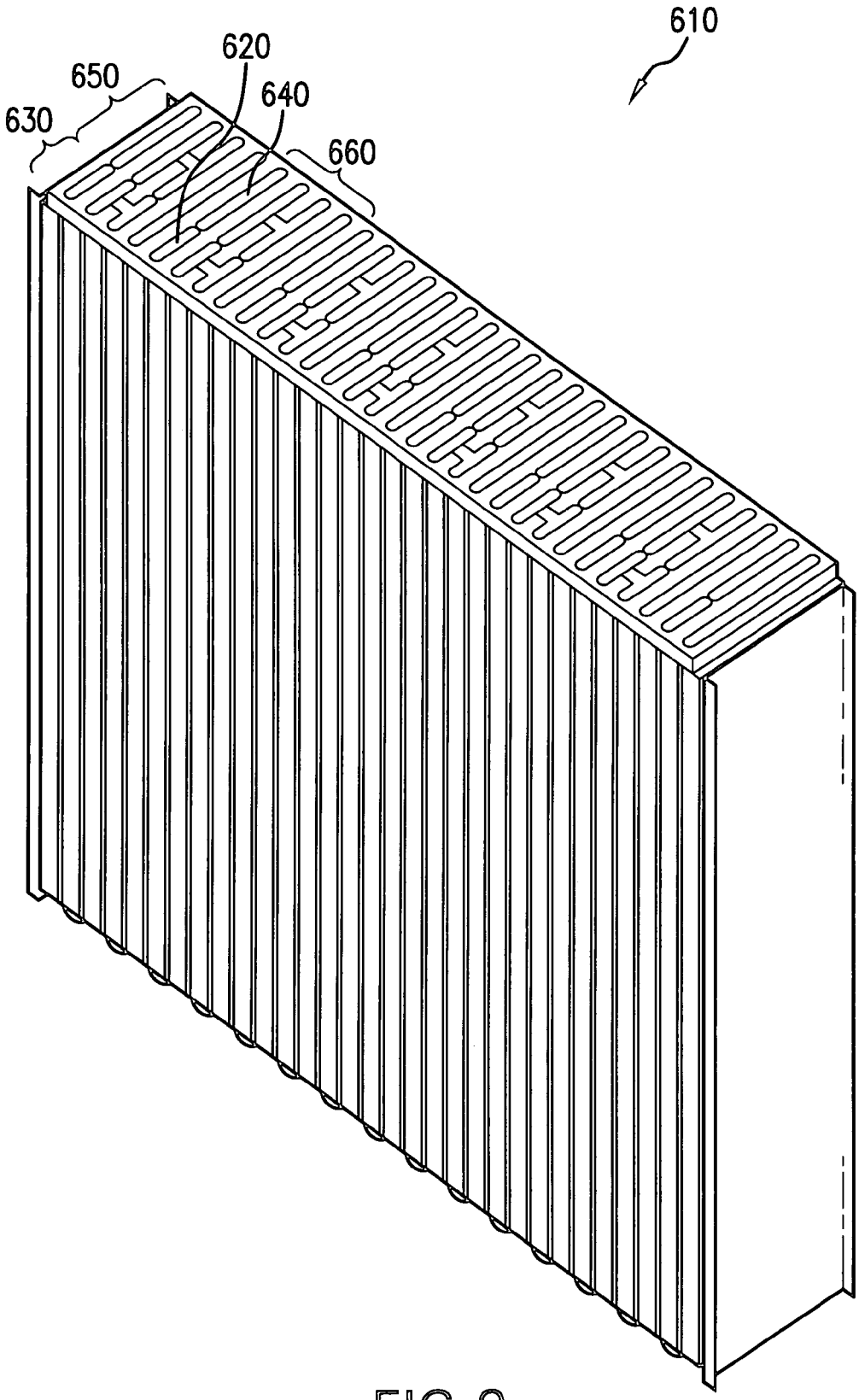
FIG. 9 shows a partial view of a heat exchanger.

FIG. 9 shows a further example of a connection arrangement for flow-path sections of a heat exchanger 610. In this case, the flow-path sections 620 on the inlet side 630 of the heat exchanger 610 have a smaller cross section of flow than the flow-path sections 640 on the outlet side 650. By way of example, if the heat exchanger 610 is used as an evaporator, this asymmetry serves to match the cross sections of flow to the density of the first medium along the flow paths 660.

Figure 10:
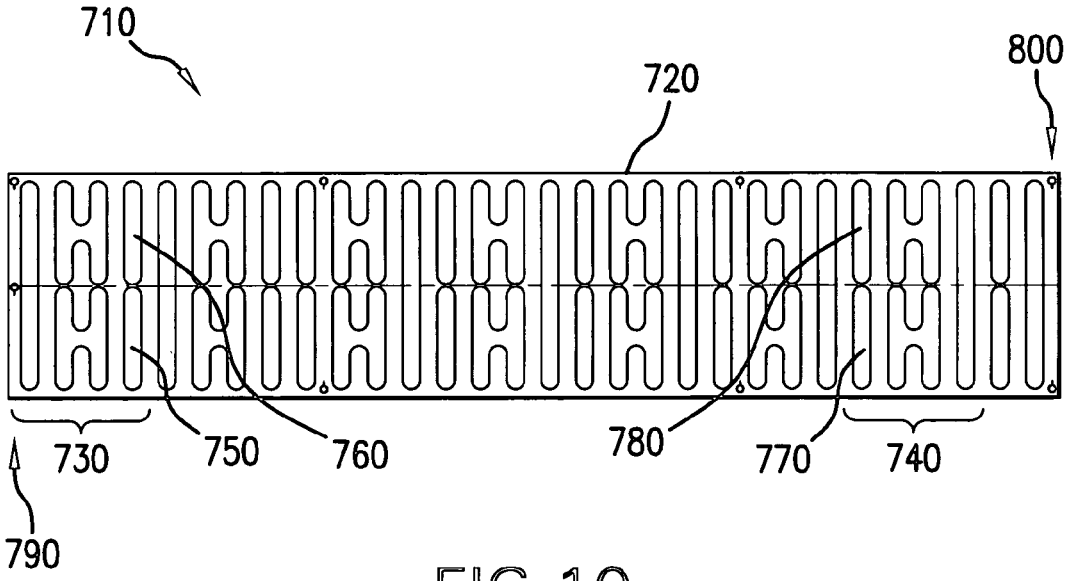
FIG. 10 shows a diverter plate.

FIG. 10 shows a further example of a connection arrangement for flow-path sections of a heat exchanger 710, produced by a configuration of through-passages and diverter passages of a diverter plate 720. In this case, the flow paths 730 and 740 are in each case oriented in such a way that an inlet and an outlet for the first medium, produced by through-passages 750, 760 and 770, 780, respectively, are arranged as far away as possible from edges 790 or 800 of the heat exchanger 710.

Figure 11:
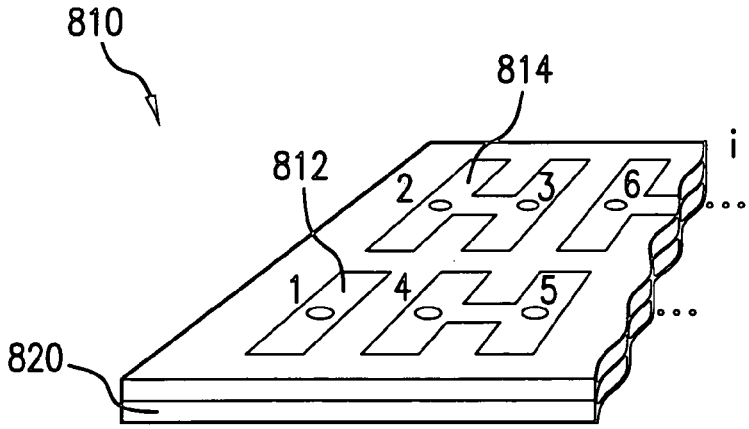
FIG. 11 shows a partial view of a tube plate.

FIG. 11 shows a further example of a connection arrangement for flow-path sections of a heat exchanger 810, produced by a configuration of through-passages 812 and diverter passages 814 of a diverter plate 820. In this case, the flow-path sections are connected to one another in the following order: 1 (downward)—2 (upward)—3 (downward)—4 (upward)—5 (downward)—6 (upward) etc.

Figure 12:
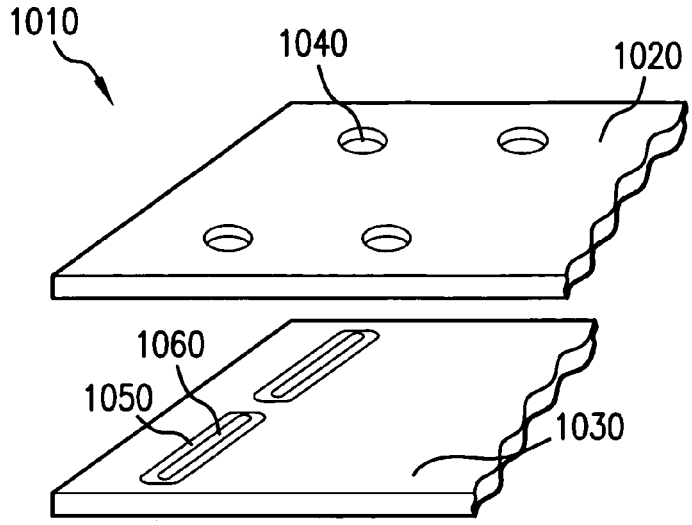
FIG. 12 shows an exploded illustration of a tube plate.

FIG. 12 shows a tube plate 1010 with a cover plate 1020 and a plate 1030 formed by integral configuration of a diverter plate with a base plate. The cover plate 1020 has cutouts 1040 for connection to two collection chambers, while through-passages 1050 of the diverter plate and, beneath them, narrower tube-receiving parts 1060 in the base plate can be seen in the plate 1030.

Figure 13:
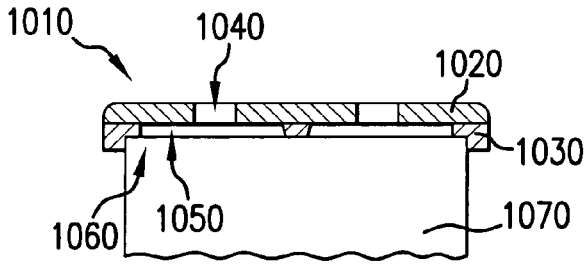
FIG. 13 shows a cross-sectional illustration of a tube plate.
Figure 14:
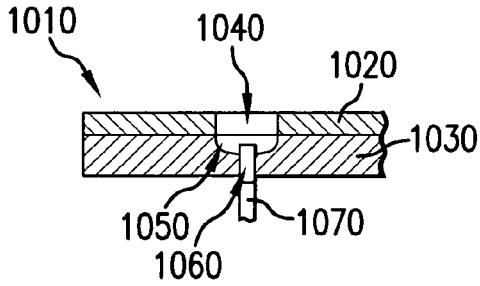
FIG. 14 shows a longitudinal section illustration of a tube plate.

FIG. 13 and FIG. 14 show the tube plate from FIG. 12 in a cross section and a longitudinal section, respectively, in each case in the assembled state with a tube 1070.

Figure 15:
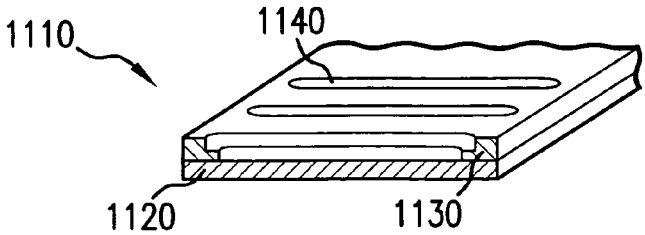
FIG. 15 shows a tube plate.

FIG. 15 shows a similar tube plate 1110, the cover plate 1120 of which does not have any cutouts. Diverter passages 1140 for diversion over the depth are arranged in the plate 1130 comprising the diverter plate and the base plate.

Figure 16:
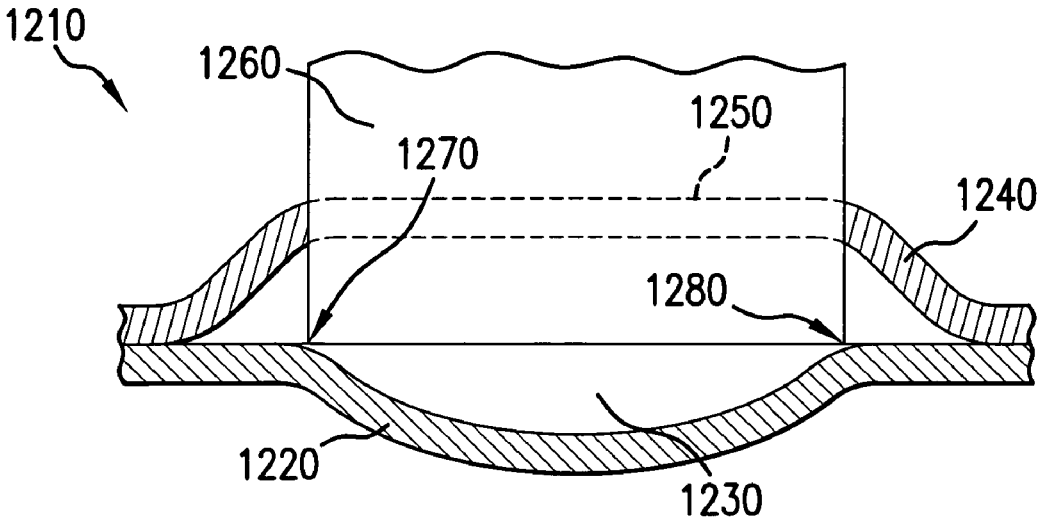
FIG. 16 shows a cross-sectional illustration of a tube plate.

FIG. 16 shows a further possible option for the configuration of a two-part tube plate 1210. In this case, the diverter plate is formed integrally with the cover plate, producing a plate 1220. The plate has a diverter passage 1230 for diversion over the depth, which is produced by a curvature. The base plate 1240 is likewise curved, so that the tube 1260 received in the cutout 1250 in the base plate 1240 is held more securely and therefore in a manner which is more resistant to pressure. The tube 1260 in this case butts against the edge 1270, 1280 of the diverter passage 1230, since the curvature in the plate 1220 is not as wide as the curvature in the plate 1240.

Figure 17:
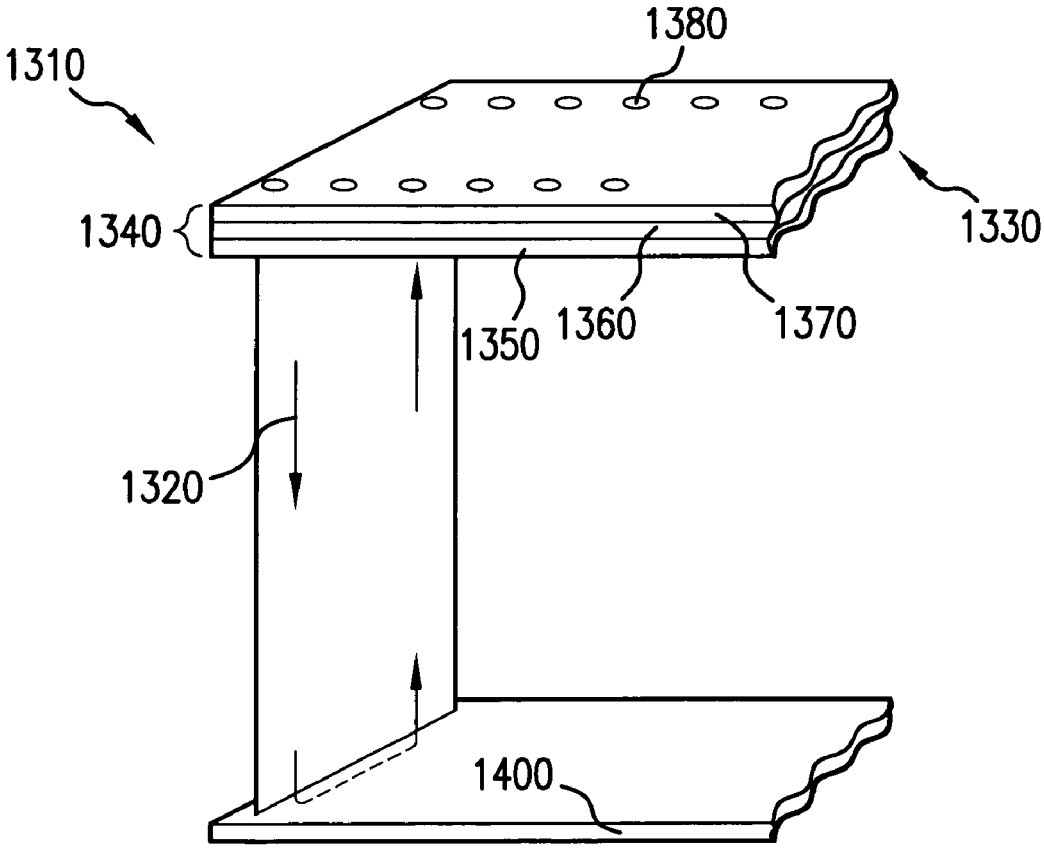
FIG. 17 shows a partial view of a heat exchanger.

FIG. 17 shows a heat exchanger 1310 of purely countercurrent design. The pure countercurrent design is distinguished by the fact that diversions take place only over the depth but not over the width. In this context, it is irrelevant how many sections the flow paths comprise. The flow paths may, for example, comprise in each case four sections, in which case three diversions per flow path are required over the depth. The heat exchanger 1310 has flow paths 1320 with in each case one diversion over the depth and accordingly with in each case two flow-path sections, which are aligned with one another in the main direction of flow of the second medium. The upper end piece 1330 has a tube plate 1340 and two collection boxes, which are not shown for the sake of clarity. The tube plate comprises a base plate 1350, a diverter plate 1360, which in this case serves merely to pass through the first medium, and a cover plate 1370 with apertures 1380 for connection to the collection boxes. The lower end piece 1390 comprises only a plate 1400, in which a base plate, a diverter plate and a cover plate are integrated. The structure of the plate 1400 is explained on the basis of FIGS. 18 and 19 below.

Figure 18:
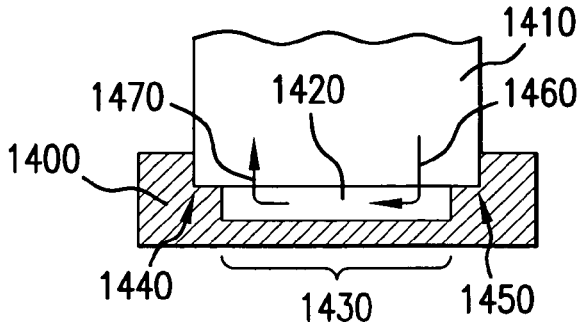
FIG. 18 shows a cross-sectional illustration of a tube plate.
Figure 19:
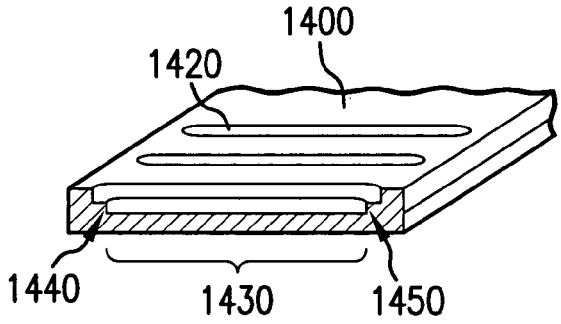
FIG. 19 shows a tube plate.

FIG. 18 shows a cross section through and FIG. 19 a cut-away oblique view of the plate 1400 from FIG. 17. A tube 1410 is received in a cutout 1420, which simultaneously serves as a diverter passage for the first medium, the diverter passage being closed off with respect to the outside by the region 1430 of the plate 1400. A narrowing provides the cutout 1420 with edges 1440, 1450 which serve as a stop for the tube 1410. This produces a single-part tube plate of very simple design and with a high ability to withstand pressure. The tube 1410 in this case serves to form two sections (downward 1460 and upward 1470) of a flow path.

Figure 20:
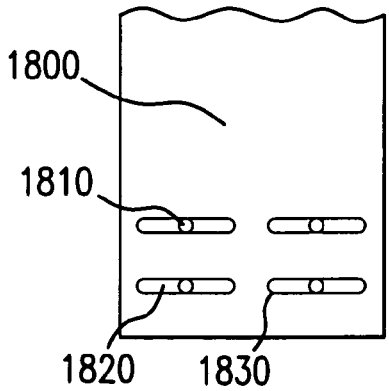
FIG. 20 shows a tube plate.

FIG. 20 shows a tube plate 1800 of similar construction, which is likewise of single-part structure and over and above the diverter passages 1820 and the tube stops 1830 also has apertures 1810 in the region of the cover plate in order to allow it to be connected to one or two collection boxes.

To summarize, the invention allows the production of a heat exchanger which comprises a row of tubes (to realize heat-exchange passages), two plates (the tube plates) and two tubes (the collection boxes). This makes it possible to realize an extremely simple and, moreover, pressure-stable structure of the heat exchanger.

FIGS. 21 to 24 show exemplary embodiments of a tube plate which involves little outlay on material and, for this reason, low materials costs and a low weight.

Figure 21:
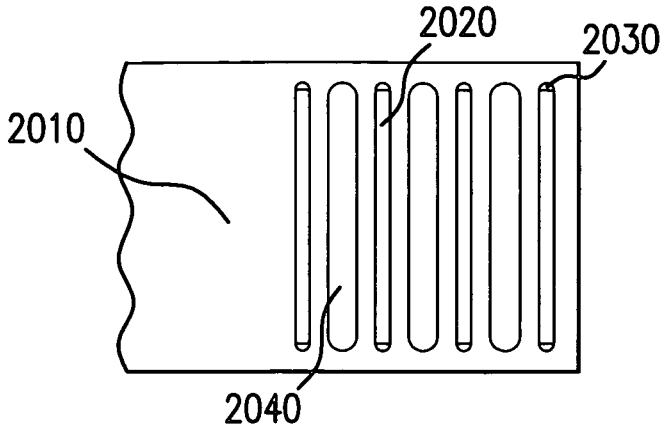
FIG. 21 shows a tube plate.
Figure 22:
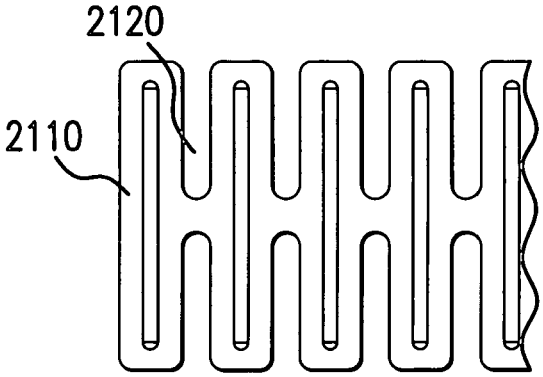
FIG. 22 shows a tube plate.
Figure 23:
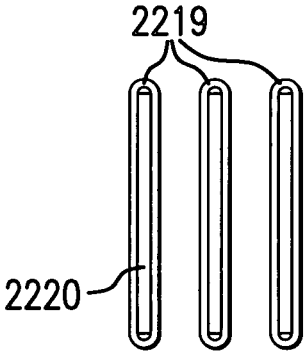
FIG. 23 shows a tube plate.
Figure 24:
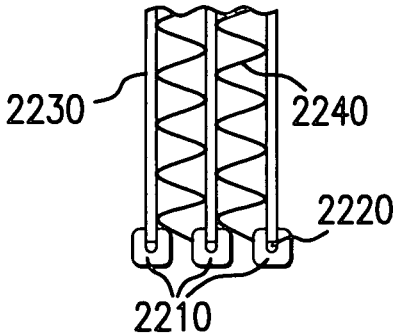
FIG. 24 shows a partial view of a heat exchanger and
FIG. 25 shows a partial view of a tube plate.

The tube plate 2010 in FIG. 21 has, between the tube-receiving cutouts 2020 with the tube-stop edges 2030, cutouts formed as apertures 2040 in order to save material. For the same reason, in the case of the tube plate 2110 shown in FIG. 22, cutouts formed as lateral notches 2120 are provided. The tube plate 2210 in FIG. 23 and FIG. 24 is completely separated between the tube-receiving cutouts 2220. In this case, the tubes 2230 may under certain circumstances be stabilized by the corrugated fins 2240 alone.

Figure 25:
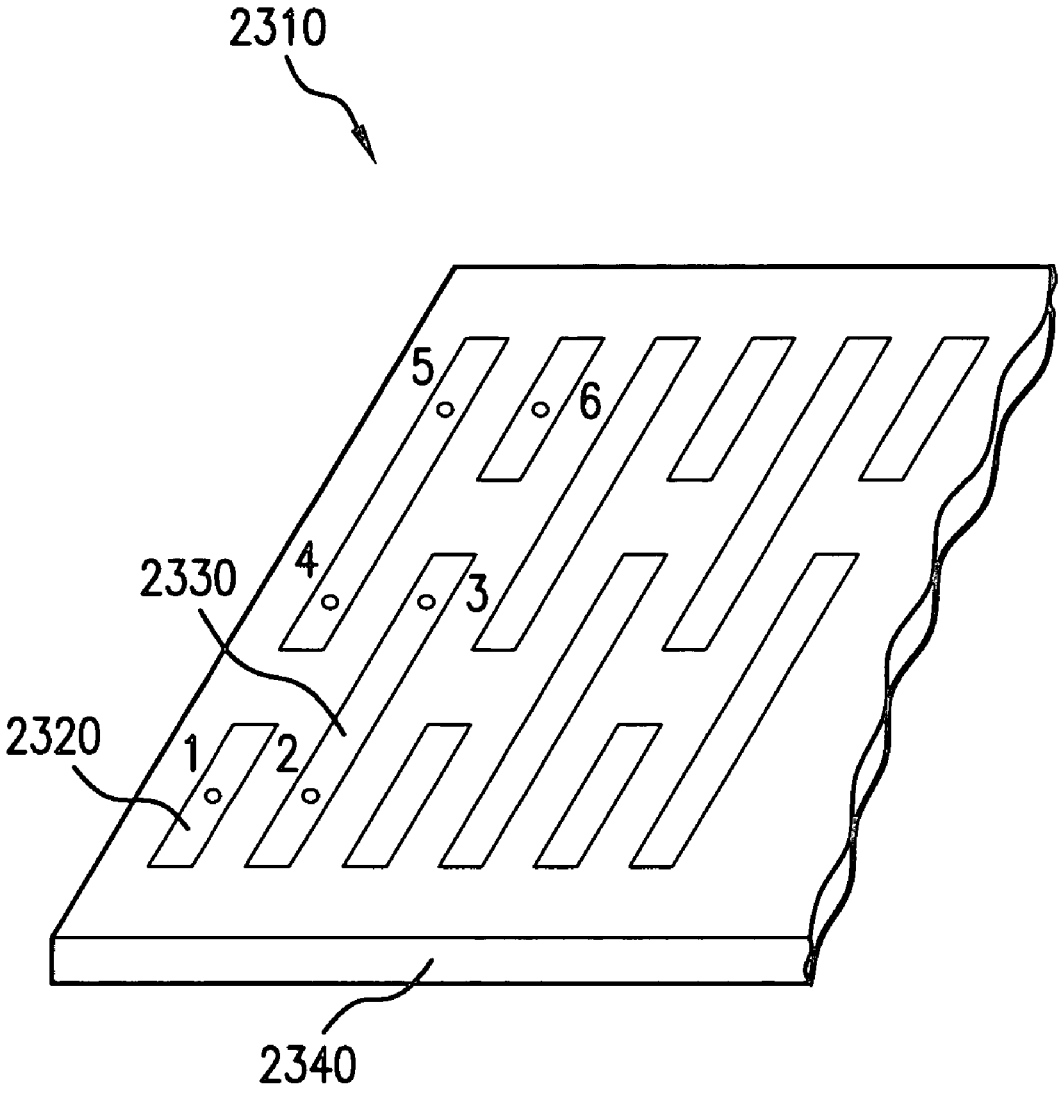

FIG. 25 shows a further example of a connection arrangement for flow-path sections of a heat exchanger 2310, produced by a configuration of through-passages 2320 and diverter passages 2330 of a diverter plate 2340. In this case, the flow-path sections are connected to one another in the following order: 1 (downward)—2 (upward)—3 (downward)—4 (upward)—5 (downward)—6 (upward). It is possible to provide a tube for each flow-path section. However, it is preferable for a tube to include two or more flow-path sections, for example the flow-path sections 1, 4 and 5 or the flow-path sections 2, 3 and 6. In this exemplary embodiment, flat tubes are particularly suitable for this purpose. Any further desired connection arrangements for flow-path sections are also conceivable over and above those illustrated.

The present invention has been described in part on the basis of the example of an evaporator. However, it should be noted that the heat exchanger according to the invention is also suitable for other uses.

The invention claimed is:

1. A heat exchanger, comprising:

tubes which comprise tube ends and through which a first medium can flow in heat-exchange passages and around which a second medium can flow, a first collection chamber and a second collection chamber, configured so that the first medium can be passed from said first collection chamber to said second collection chamber, and at least one end piece, which comprises a tube plate and a collection box, wherein said tube plate comprises individual plates bearing against one another, said individual plates including a base plate, a diverter plate, and a cover plate, wherein said tube ends are connected to said base plate, and at least one through-passage is formed by a cutout in said diverter plate and is closed off in a fluid-tight manner with respect to an environment surrounding the heat exchanger by said cover plate, and wherein said collection box comprises a housing and at least one collection chamber selected from the group consisting of said first collection chamber and said second collection chamber, said housing and said cover plate having apertures which are aligned with one another and through which said at least one collection chamber is in communication with said at least one through-passage.

2. The heat exchanger as claimed in claim 1, wherein the collection box is welded or soldered to the cover plate.

3. The heat exchanger as claimed in claim 1, wherein the collection box is formed integrally with the cover plate.

4. The heat exchanger as claimed in claim 1, wherein the collection box is of tubular design.

5. The heat exchanger as claimed in claim 1, wherein the cover plate, at edges of apertures, has extensions which engage in apertures in the collection box housing.

6. The refrigerant heat exchanger as claimed in claim 5, wherein the diameter of the bores is variable.

7. The heat exchanger as claimed in claim 1, wherein the housing of the collection box, at the edges of said apertures, has extensions which engage in apertures in the cover plate.

8. The heat exchanger as claimed in claim 1, wherein through-openings are respectively formed by two aligned apertures, and wherein said through-openings have different cross sections of flow.

9. The heat exchanger as claimed in claim 8, wherein the through-openings with different cross sections of flow are arranged upstream of the heat-exchange passages.

10. The heat exchanger as claimed in claim 8, wherein the cross sections of flow of the through-openings increase in the direction of a decreasing pressure of the first medium inside the collection chamber in a region of the through-openings while the heat exchanger is operating.

11. The heat exchanger as claimed in claim 8, wherein the cross sections of flow of the through-openings increase in the direction of a decreasing density of the first medium within the collection chamber in a region of the through-openings while the heat exchanger is operating.

12. The heat exchanger as claimed in claim 1, wherein a cross-sectional area of the first collection chamber is larger or smaller than a cross-sectional area of the second collection chamber.

13. The heat exchanger as claimed in claim 12, wherein a ratio of the cross-sectional areas of the first and second collection chambers is approximately equal to the reciprocal of a ratio of the densities of the first medium within the first and second collection chambers, respectively, while the heat exchanger is operating.

14. The heat exchanger as claimed in claim 1, further comprising at least on flow path which comprises a plurality of flow-path sections, wherein each flow-path section of said plurality of flow-path sections comprises at least one of said heat-exchange passages, configured so that the first medium can be passed along said at least one flow path, wherein at least one diverter passage is formed by a cutout in the diverter plate and closed off in a fluid-tight manner with respect to an environment surrounding the heat exchanger by said cover plate, wherein the at least one diverter passage connects the at least one heat-exchange passage of a first flow-path section of said plurality of flow-path sections to the heat-exchange passage of a second flow-path section, whereby the first medium can successively flow through said first and second flow-path sections.

15. The heat exchanger as claimed in claim 14, wherein for each flow path hydraulically the first section is arranged in a tube which, within a row of tubes, is adjoined by tubes on two opposite sides.

16. The heat exchanger as claimed in claim 14, wherein all sections of at least one flow path are aligned with one another in the main direction of flow of the second medium.

17. The heat exchanger as claimed in claim 14, wherein the number of sections of at least one flow path can be divided by four.

18. The heat exchanger as claimed in claim 1, wherein a tube has a cutout at a tube end and the tube plate has a tube-receiving part with a web, the cutout and the web being of identical width.

19. The heat exchanger as claimed in claim 18, wherein the height of the cutout is greater than that of the web.

20. The heat exchanger as claimed in claim 18, wherein the cutout and the web are of identical height.

21. The heat exchanger as claimed in claim 18, wherein the height of the cutout is greater than that of the web.

22. The heat exchanger as claimed in claim 1, wherein the diverter plate is formed integrally with the base plate and/or with the cover plate.

23. The heat exchanger as claimed in claim 1, wherein the base plate, the diverter plate and/or the cover plate are fully separated in regions between through-passages and/or diverter passages and/or have cutouts in the form of apertures or notches.

24. The heat exchanger as claimed in claim 1, wherein a tube is deformed into a U shape one or more times.

25. The heat exchanger as claimed in claim 1, wherein the heat exchanger has precisely one end piece with a tube plate comprising individual plates bearing against one another.

26. The heat exchanger as claimed in claim 1, wherein the diverter plate is welded or soldered to the base plate and/or to the cover plate.

27. The heat exchanger as claimed in claim 1, wherein a first plate selected from the group consisting of the base plate, the diverter plate, and the cover plate has at least one first aperture and a second plate selected from the group consisting of the base plate, the diverter plate, and the cover plate, has second aperture, and wherein said first aperture comprises a protrusion at an edge of said first aperture, said protrusion engaging into said second aperture.

28. The heat exchanger as claimed claim 1, wherein the tubes are welded or soldered to the base plate.

29. The heat exchanger as claimed in claim 1, wherein the tubes are formed as flat tubes.

30. The refrigerant exchanger as claimed in claim 1, wherein the diverter device is formed by a further base plate with receiving openings and webs, which form a joined connection with the end-side groove of the flat tubes.

31. The refrigerant heat exchanger as claimed in claim 30, wherein the diverter device additionally has a passage plate with continuous slots and a closed cover plate.

32. The refrigerant heat exchanger as claimed in claim 1, wherein the width b of the passage openings in the passage plate is greater than the width a of the receiving openings in the base plate.

33. The refrigerant heat exchanger as claimed in claim 1, wherein the depth of the groove in the flat-tube ends is greater than the thickness of the base plate.

34. A heat exchanger, comprising:

tubes which comprise tube ends and through which a first medium can flow in heat-exchange passages and around which a second medium can flow, at least one flow path which comprises a plurality of flow-path sections, wherein each flow-path section of said plurality of flow-path sections comprises at least one of said heat-exchange passages and which is configured so that it is possible for the first medium to be passed along said at least one flow path, and at least one end piece, which comprises a tube plate, wherein said tube plate comprises individual plates bearing against one another, said individual plates comprising a base plate, a diverter plate, and a cover plate, wherein said tube ends are connected to said base plate, and at least one diverter passage is formed by a cutout in said diverter plate and closed off in a fluid-tight manner with respect to an environment surrounding the heat exchanger by said cover plate, and wherein the at least one diverter passage connects the at least one heat-exchange passage of a first flow-path section of said plurality of flow-path sections to the heat-exchange passage of a second flow-path section, whereby the first medium can successively flow through said first and second flow-path sections.

35. The heat exchanger as claimed in claim 34, wherein said first and second flow-path sections are arranged laterally beside each other in the main direction of flow of the second medium.

36. The heat exchanger as claimed in claim 34, wherein said first and second flow-path sections are aligned with one another in the main direction of flow of the second medium.

37. The refrigerant heat exchanger as claimed in claim 36, wherein in each case two U-tubes are connected in series on the refrigerant side, and in that in each case two adjacent passage openings, which are assigned to a U-tube outlet and a U-tube inlet, are in refrigerant communication with one another via a transverse passage in the passage plate.

38. The heat exchanger as claimed in claim 34, wherein said first and second flow-path sections are arranged in a single tube.

39. The heat exchanger as claimed in claim 34, wherein the number of sections of at least one flow path can be divided by two, in particular, by four.

40. The heat exchanger as claimed in claim 34, wherein the at least one flow path comprises two adjacent flow paths running mirror-symmetrically with respect to one another.

41. The heat exchanger as claimed in claim 34, wherein the at least on flow path comprises two flow paths each having a diverter passage, wherein the diverter passages of said two flow paths communicate with one another.

42. The heat exchanger as claimed in claim 34 wherein a cross section of flow of said first flow path section is different from a cross section of flow of said second flow path section.

43. The heat exchanger as claimed in claim 42, wherein the density of the first medium decreases from the first flow path section to the second flow path section, and wherein the cross section of flow of said first flow path section is larger than the cross section of flow of said second flow path section.

44. The heat exchanger as claimed in claim 42, wherein the density of the first medium increases from the first flow path section to the second flow path section, and wherein the cross section of flow of said first flow path section is smaller than the cross section of flow of said second flow path section.

45. The heat exchanger as claimed in claim 34, wherein a tube is deformed into a U shape one or more times.

46. The heat exchanger as claimed in claim 34, wherein the heat exchanger comprises precisely one end piece with a tube plate comprising individual plates bearing against one another.

47. A heat exchanger, comprising:

tubes which comprise tube ends and through which a first medium can flow in heat-exchange passages and around which a second medium can flow, and at least one end piece, which comprises a tube plate which comprises individual plates bearing against one another, wherein said individual plates comprise a base plate, a diverter plate, and a cover plate, wherein said tube ends are connected to said base plate, and at least one through-passage and/or diverter passage is formed by a cutout in said diverter plate and closed off in a fluid-tight manner with respect to an environment surrounding the heat exchanger by said cover plate, and wherein a tube comprises a cutout at a tube end and the base plate comprises a tube-receiving part with a web, the cutout and the web being of identical width.

48. The heat exchanger as claims in claim 47, wherein the cutout and the web are of identical height.

49. The heat exchanger as claimed in claim 47, wherein the height of the cutout is greater than that of the web.

50. The heat exchanger as claimed in claim 47, wherein a tube is deformed into a U shape one or more times.

51. The heat exchanger as claimed in claim 47, wherein the heat exchanger comprises precisely one end piece with a tube plate comprising individual plates bearing against one another.

52. A heat exchanger, comprising:

tubes which comprise tube ends and through which a first medium can flow in heat-exchange passages and around which a second medium can flow, and at least one end piece, which comprises a tube plate which comprises individual plates bearing against one another, said individual plates comprising a base plate, a diverter plate, and a cover plate, wherein said tube ends are connected to said base plate, and at least one through-passage and/or diverter passage is formed by a cutout in said diverter plate and closed off in a fluid-tight manner with respect to an environment surrounding the heat exchanger by said cover plate, wherein at least one tube is deformed into a U shape one or more times.

53. The heat exchanger as claimed in claim 52, wherein the ends of the at least one deformed tube can be connected to the same base plate.

54. The heat exchanger as claimed in claim 52, wherein the heat exchanger comprises precisely one end piece with a tube plate comprising individual plates bearing against one another.

55. A heat exchanger, comprising:

tubes which comprise tube ends and through which a first medium can flow in heat-exchange passages and around which a second medium can flow, and precisely one end piece, which comprises a tube plate which comprises individual plates bearing against one another, said individual plates comprising a base plate, a diverter plate, and a cover plate, wherein said tube ends are connected to said base plate, and wherein at least one through-passage and/or diverter passage is formed by a cutout in said diverter plate and closed off in a fluid-tight manner with respect to an environment surrounding the heat exchanger by said cover plate.

* * * * *

UNITED STATES PATENT AND TRADEMARK OFFICE

CERTIFICATE OF CORRECTION

PATENT NO. : 7,481,266 B2
APPLICATION NO. : 10/499440
DATED : January 27, 2009
INVENTOR(S) : Demuth et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 928 days.

Signed and Sealed this

Twenty-sixth Day of October, 2010

David J. Kappos

David J. Kappos
*Director of the United States Patent and Trademark Office*